US010789872B2

(12) United States Patent
Ahn et al.

(10) Patent No.: US 10,789,872 B2
(45) Date of Patent: Sep. 29, 2020

(54) DISPLAY APPARATUS WITH ENHANCED APERTURE RATIO

(71) Applicant: Samsung Display Co., Ltd, Yongin-si, Gyeonggi-do (KR)

(72) Inventors: Kuk-Hwan Ahn, Hwaseong-si (KR); Hyunkyu Namkung, Cheonan-si (KR); Heendol Kim, Yongin-si (KR); Seokyun Son, Suwon-si (KR); Jai-hyun Koh, Hwaseong-si (KR); Iksoo Lee, Seoul (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/009,673

(22) Filed: Jan. 28, 2016

(65) Prior Publication Data

US 2016/0232829 A1 Aug. 11, 2016

(30) Foreign Application Priority Data

Feb. 6, 2015 (KR) ..... 10-2015-0018859

(51) Int. Cl.
*G09G 3/36* (2006.01)
*G09G 3/20* (2006.01)

(52) U.S. Cl.
CPC ..... *G09G 3/2003* (2013.01); *G09G 2300/043* (2013.01); *G09G 2300/0452* (2013.01); *G09G 2300/0465* (2013.01); *G09G 2310/08* (2013.01); *G09G 2320/0242* (2013.01); *G09G 2320/0276* (2013.01); *G09G 2340/0457* (2013.01)

(58) Field of Classification Search
CPC ..... G09G 2310/08; G09G 2300/0452
USPC ..... 345/87–88
See application file for complete search history.

(56) References Cited

U.S. PATENT DOCUMENTS 5,995,072 A * 11/1999 Nakajima ..... G09G 3/3611 345/204
7,002,606 B2 * 2/2006 Tanaka ..... H04N 9/12 345/690
7,417,648 B2 8/2008 Credelle
7,474,303 B2 * 1/2009 Shin ..... G09G 3/3413 345/204
7,583,279 B2 9/2009 Brown-Elliott
(Continued)

FOREIGN PATENT DOCUMENTS

CN 101636676 A 1/2010
CN 105321448 A 2/2016
(Continued)

OTHER PUBLICATIONS

Japanese Office Action Report, Application No. 2016-018736 dated Dec. 10, 2019, 3 pages.

*Primary Examiner* — Roy P Rabindranath
(74) *Attorney, Agent, or Firm* — Innovation Counsel LLP

(57) ABSTRACT

Provided is a display apparatus including a display panel, a timing controller, a gate driver, and a data driver. The display panel includes a plurality of pixels and a plurality of sub-pixels. Two pixels among the pixels include five sub-pixels and temporally share a third sub-pixel among the five sub-pixels. The timing controller includes a filter that is set based on a region having the same area as four sub-pixels. The timing controller generates RGBW data having red, green, blue, and white data based on input data, and applies the filter to the RGBW data to generate output data corresponding to each of the sub-pixels.

18 Claims, 19 Drawing Sheets

(56) References Cited

U.S. PATENT DOCUMENTS

| | | | | |
|---|---|---|---|---|
| 7,876,341 | B2 | 1/2011 | Credelle et al. | |
| 8,159,426 | B2 | 4/2012 | Chang et al. | |
| 8,808,402 | B2 | 8/2014 | Krijne et al. | |
| 9,177,527 | B2 | 11/2015 | Nakagawa et al. | |
| 10,157,564 | B2 | 12/2018 | Park et al. | |
| 2003/0128225 | A1* | 7/2003 | Credelle | G02F 1/133514 345/694 |
| 2004/0051724 | A1* | 3/2004 | Elliott | G02F 1/133514 345/694 |
| 2004/0080479 | A1 | 4/2004 | Crdelle | |
| 2008/0084376 | A1* | 4/2008 | Hirota | G09G 3/3607 345/88 |
| 2010/0118061 | A1* | 5/2010 | Suzuki | G09G 3/3648 345/690 |
| 2011/0234643 | A1* | 9/2011 | Park | G09G 5/10 345/690 |
| 2012/0206512 | A1* | 8/2012 | Kim | G02F 1/133514 345/691 |
| 2013/0222436 | A1* | 8/2013 | Park | G09G 5/06 345/690 |
| 2014/0152714 | A1 | 6/2014 | Nakagawa et al. | |
| 2015/0116375 | A1* | 4/2015 | Yang | G09G 3/2003 345/690 |
| 2015/0123083 | A1* | 5/2015 | Xi | H01L 27/322 257/40 |
| 2016/0042711 | A1* | 2/2016 | Kim | G09G 3/3688 345/691 |
| 2016/0055781 | A1* | 2/2016 | Phan | G09G 3/2003 345/690 |

FOREIGN PATENT DOCUMENTS

| | | | |
|---|---|---|---|
| JP | 2006215559 | A | 8/2006 |
| JP | 2012-203117 | A | 10/2012 |
| KR | 10-0825106 | B1 | 4/2008 |
| KR | 10-2009-0073903 | A | 7/2009 |
| KR | 10-20110026225 | A | 3/2011 |
| KR | 10-1066416 | B1 | 9/2011 |
| KR | 10-2012-0007022 | A | 1/2012 |
| KR | 10-2012-0093003 | A | 8/2012 |
| KR | 10-1254032 | B1 | 4/2013 |
| WO | 2013008887 | A1 | 1/2013 |

* cited by examiner

FIG. 9A

RF1

| | | |
|---|---|---|
| 0 | 32 | 0 |
| 32 | 152 | 8 |
| 0 | 32 | 0 |

FIG. 9B

RF2

| | |
|---|---|
| 16 | 16 |
| 96 | 96 |
| 16 | 16 |

FIG. 9C

RF3

| | | |
|---|---|---|
| 0 | 32 | 0 |
| 8 | 152 | 32 |
| 0 | 32 | 0 |

FIG. 9D

RF4

| | |
|---|---|
| 4 | 28 |
| 64 | 128 |
| 4 | 28 |

FIG. 9E

RF5

| | |
|---|---|
| 28 | 4 |
| 128 | 64 |
| 28 | 4 |

FIG. 10A

MF1

| | | |
|---|---|---|
| 0 | -32 | 0 |
| -32 | 104 | -8 |
| 0 | -32 | 0 |

FIG. 10B

MF2

| | |
|---|---|
| -16 | -16 |
| -32 | 96 |
| -16 | -16 |

FIG. 10C

MF3

| | | |
|---|---|---|
| 0 | 32 | 0 |
| 8 | 152 | 32 |
| 0 | 32 | 0 |

FIG. 10D

MF4

| | |
|---|---|
| -4 | -28 |
| -64 | 128 |
| -4 | -28 |

FIG. 10E

MF5

| | |
|---|---|
| -28 | -4 |
| 64 | 0 |
| -28 | -4 |

FIG. 11A

SF1

| | | |
|---|---|---|
| -16 | 0 | -16 |
| 0 | 40 | 24 |
| -16 | 0 | -16 |

FIG. 11B

SF2

| | |
|---|---|
| -16 | -16 |
| -32 | 96 |
| -16 | -16 |

FIG. 11C

SF3

| | | |
|---|---|---|
| -20 | -12 | 0 |
| 32 | 0 | 32 |
| -20 | -12 | 0 |

FIG. 11D

SF4

| | |
|---|---|
| -36 | -4 |
| 0 | 128 |
| -36 | -4 |

FIG. 11E

SF5

| | |
|---|---|
| -28 | -4 |
| 0 | 64 |
| -28 | -4 |

DISPLAY APPARATUS WITH ENHANCED APERTURE RATIO

CROSS-REFERENCE TO RELATED APPLICATIONS

This U.S. non-provisional patent application claims priority under 35 U.S.C. §119 of Korean Patent Application No. 10-2015-0018859, filed on Feb. 6, 2015, the entire content of which is hereby incorporated by reference.

BACKGROUND

The present disclosure herein relates to a display apparatus, and more particularly, to a display apparatus that performs a data rendering operation.

Each pixel of a typical display apparatus includes three sub-pixels that display red, green, and blue colors, respectively. Such a structure is called an RGB-stripe structure.

Recently, a technique for enhancing luminance of a display apparatus using an RGBW structure in which one pixel includes four sub-pixels, that is, red, green, blue, and white sub-pixels is being developed. Furthermore, a technique for increasing an overall aperture ratio and a transmittance factor of a display apparatus using a structure designed such that two sub-pixels (two of R, G, B, and W sub-pixels) are formed in an area where each pixel of the RGB-stripe structure is formed is also being developed.

SUMMARY

The present disclosure provides a display apparatus having a higher transmittance factor and a higher aperture ratio. The present disclosure also provides a display apparatus having higher color reproduction.

The present disclosure also provides a display apparatus for performing a data rendering operation suitable for a new pixel structure.

Embodiments of the inventive concept provide a display apparatus including a display panel, a timing controller, a gate driver, and a data driver.

The display panel may include a plurality of pixels each including a plurality of sub-pixels. Two of the pixels may include five of the sub-pixels and temporally share one of the five sub-pixels.

The timing controller may include a filter that is set based on a region having the same area as four sub-pixels. The timing controller may generate RGBW data having red, green, blue, and white data based on input data, and may apply the filter to the RGBW data to generate output data corresponding to each of the sub-pixels.

The gate driver may provide gate signals to the sub-pixels.

The data driver may provide data voltages corresponding to the output data to the sub-pixels.

In some embodiments, the sub-pixels may be repeatedly arranged in units of a sub-pixel group including 8 sub-pixels arranged in a 2×4 or 4×2 matrix, and the sub-pixel group may include two red sub-pixels, two green sub-pixels, two blue sub-pixels, and two white sub-pixels.

In other embodiments, an aspect ratio of each of the pixels may be substantially 1:1.

In still other embodiments, an aspect ratio of each of the sub-pixels may be substantially 1:2.5.

In even other embodiments, sub-pixels arranged in a 2×5 matrix form a square-like shape.

In yet other embodiments, the timing controller may include a gamma correction unit, a gamut mapping unit, a data determination unit, a sub-pixel rendering unit, and a reverse gamma correction unit.

The gamma correction unit may linearize the input data. The gamut mapping unit may map the linearized input data to red, green, blue, and white color gamuts to generate the RGBW data. The saturation data determination unit may analyze the RGBW data for each piece of unit pixel data corresponding to each of the pixels and generate a saturation signal having information whether to have saturated color data. The sub-pixel rendering unit may perform a rendering operation on the RGBW data to generate rendering data corresponding to each of the sub-pixels. The reverse gamma correction unit may non-linearize the rendering data.

The filter may include a re-sampling filter and a box filter. The re-sampling filter 2151 may generate sub-pixel rendering data corresponding to a target pixel based on data corresponding to the target pixel and data corresponding to pixels adjacent to the target pixel among the RGBW data. The box filter may compensate for a dot pattern or diagonal pattern including the red, green, or blue color of the RGBW data.

In further embodiments, the sub-pixel rendering unit may include a meta-sharp filter, a self-sharpening filter, a pattern detection filter, and a saturated color detection filter.

The meta-sharp filter may compensate for distortion by applying the re-sampling filter to the RGBW data. The self-sharpening filter may compensate for distortion by applying the re-sampling filter to a horizontal line pattern or vertical line pattern including a red, green, or blue color of the RGBW data. The pattern detection filter may include a first input terminal and a second input terminal and may analyze the RGBW data and selectively output any one of data received through the first input terminal and data received through the second input terminal according to whether a dot pattern or diagonal pattern is detected. The saturated color detection filter may include a third input terminal and a fourth input terminal and may analyze the saturation signal and selectively output any one of data received through the third input terminal and data received through the fourth input terminal according to whether a saturated color is detected.

In still further embodiments, data obtained by adding data obtained by applying the re-sampling filter to the RGBW data and data obtained by applying the self-sharpening filter to the RGBW data may be input to the first input terminal of the pattern detection filter. Data obtained by applying the box filter to the RGBW data may be input to the second input terminal of the pattern detection filter.

In even further embodiments, data obtained by adding data obtained by applying the re-sampling filter to the RGBW data and data obtained by applying the meta-sharp filter to the RGBW data may be input to the third input terminal of the saturated color detection filter. Data output from the pattern detection filter may be input to the fourth input terminal of the saturated color detection filter.

In yet further embodiments, the re-sampling filter may include first to fifth re-sampling filters. The meta-sharp filter may include first to fifth meta-sharp filter calculated corresponding to the first to fifth re-sampling filters, respectively. The self-sharpening filter may include first to fifth self-sharp filters calculated corresponding to the first to fifth re-sampling filters, respectively. The box filter may include first to fifth box filters.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings:

FIGS. 9A, 9B, 9C, 9D, and 9E are views illustrating first to fifth re-sampling filters;

FIGS. 10A, 10B, 10C, 10D, and 10E are views illustrating first to fifth meta-sharp filters;

FIGS. 11A, 11B, 11C, 11D, and 11E are views illustrating first to fifth self-sharp filters;

DETAILED DESCRIPTION OF THE EMBODIMENTS

While embodiments of the inventive concept may be embodied in various modifications and alternative forms, specific embodiments thereof will be described herein in detail and shown by way of example. It should be understood, however, that it is not intended to limit the inventive concept to the particular forms disclosed, but, on the contrary, the inventive concept is to cover all modifications and alternatives falling within the spirit and scope of the inventive concept.

Figure 1:
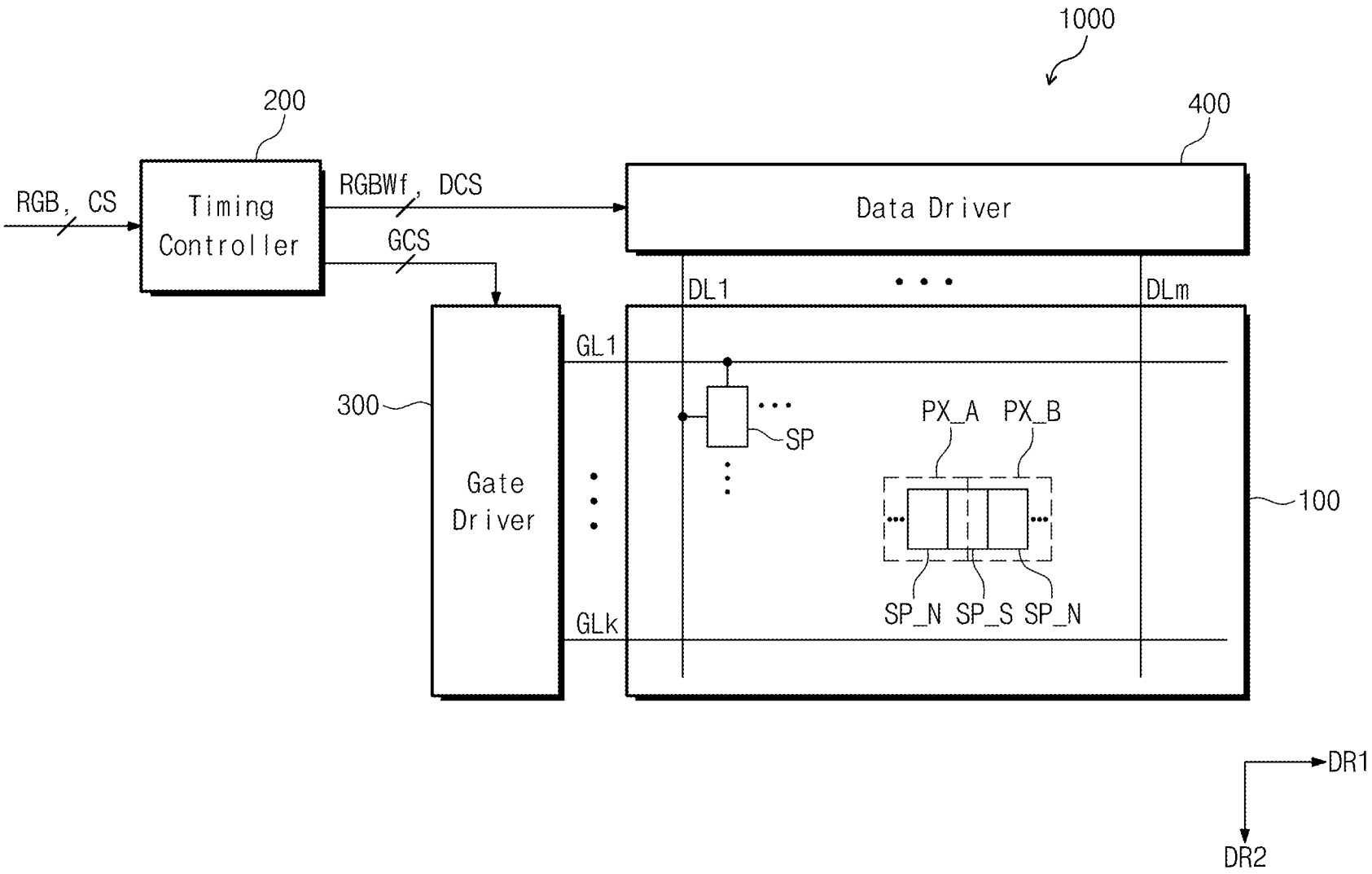
FIG. 1 is a schematic block diagram illustrating a display apparatus according to an embodiment of the inventive concept.

FIG. 1 is a schematic block diagram illustrating a display apparatus according to an embodiment of the inventive concept.

Referring to FIG. 1, a display apparatus 1000 according to an embodiment of the inventive concept includes a display panel 100, a timing controller 200, a gate driver 300, and a data driver 400.

The display panel 100 displays an image. Examples of the display panel 100 may include, but are not limited to, a liquid crystal display panel, an organic light emitting display panel, an electrophoretic display panel, and an electrowetting display panel.

When the display panel 100 is the organic light emitting display panel, which is a self-emitting display panel, a backlight unit that provides light to the display panel 100 is not required. On the contrary, when the display panel 100 is the liquid crystal display panel, which is a non-emitting display panel, the display apparatus 1000 may further include a backlight unit (not shown) for providing light to the display panel 100.

The display panel 100 may include a plurality of gate lines GL1 to GLk that extend in a first direction DR1, and a plurality of data lines DL1 to DLm that extend in a second direction DR2 intersecting with the first direction DR1.

The display panel 100 includes a plurality of sub-pixels SP. The sub-pixels SP may be connected to the respective gate lines GL1 to GLk and the respective data lines DL1 to DLm. FIG. 1 illustrates, as an example, a sub-pixel SP connected to a first gate line GL1 and a first data line DL1.

The display panel 100 may include a plurality of pixels PX_A and PX_B. Each of the plurality of pixels PX_A and PX_B may include x.5 (x is a natural number) sub-pixels. That is, each of the plurality of pixels PX_A and PX_B may have x normal sub-pixels SP_N and have a certain share of one shared sub-pixel SP_S. Two pixels PX_A and PX_B may share one shared sub-pixel SP_S. In an embodiment of the inventive concept, it is described as an example that each of the plurality of pixels PX_A and PX_B includes 2.5 sub-pixels.

The timing controller 200 receives input data RGB and a control signal CS from an external graphic control unit (not shown). The input data RGB may be composed of red data, green data, and blue data. The control signal CS may include a vertical synchronization signal, which is a frame identification signal; a horizontal synchronization signal, which is a row synchronization signal; a data enable signal, which is in a high level during a data output period to indicate a zone to which data is input; and a main clock signal.

The timing controller 200 generates data corresponding to the sub-pixels SP on the basis of the input data RGB and converts a data format of the generated data according to an interface specification of the data driver 400. The timing controller 200 outputs the converted output data RGBWf to the data driver 400. Specifically, the timing controller 200 performs a rendering operation on the basis of the input data RGB to generate data corresponding to the sub-pixels SP. A detailed description thereof will be provided below.

The timing controller 200 generates a gate control signal GCS and a data control signal DCS on the basis of the control signal CS. The timing controller 200 outputs the gate control signal GCS to the gate driver 300 and outputs the data control signal DCS to the data driver 400.

The gate control signal GCS is a signal for driving the gate driver 300, and the data controls signal DCS is a signal for driving the data driver 400.

The gate driver 300 generates a gate signal on the basis of the gate control signal GCS and outputs the generated gate signal to the gate lines GL1 to GLk. The gate control signal GCS may include a scan start signal for instructing a scan start, at least one clock signal that controls an output period of a gate-on voltage, and an output enable signal for limiting a duration of the gate-on voltage.

The data driver 400 generates a grayscale voltage according to the output data RGBWf that is converted based on the data control signal DCS, and outputs the generated grayscale voltage as a data voltage to the data lines DL1 to DLm. The data control signal DCS may include a horizontal start signal STH for informing that the converted output data RGBWf starts to be transmitted to the data driver 400, a load signal for instructing to apply a data voltage to the data lines DL1 to DLm, and an inversion signal (for a liquid crystal display panel) for inverting a polarity of a data voltage with respect to a common voltage.

Each of the timing controller 200, the gate driver 300, and the data driver 400 is directly installed in the display panel 100 in the form of at least one integrated circuit chip, installed on a flexible printed circuit board to be attached to the display panel 100 in the form of a tape carrier package (TCP), or installed on a separate printed circuit board. On the contrary, at least one of the gate driver 300 and the data driver 400 may be integrated in the display panel 100 together with the gate lines GL1 to GLk and the data lines DL1 to DLm. In addition, the timing controller 200, the gate driver 300, and the data driver 400 may be integrated as a single chip.

Figure 2:
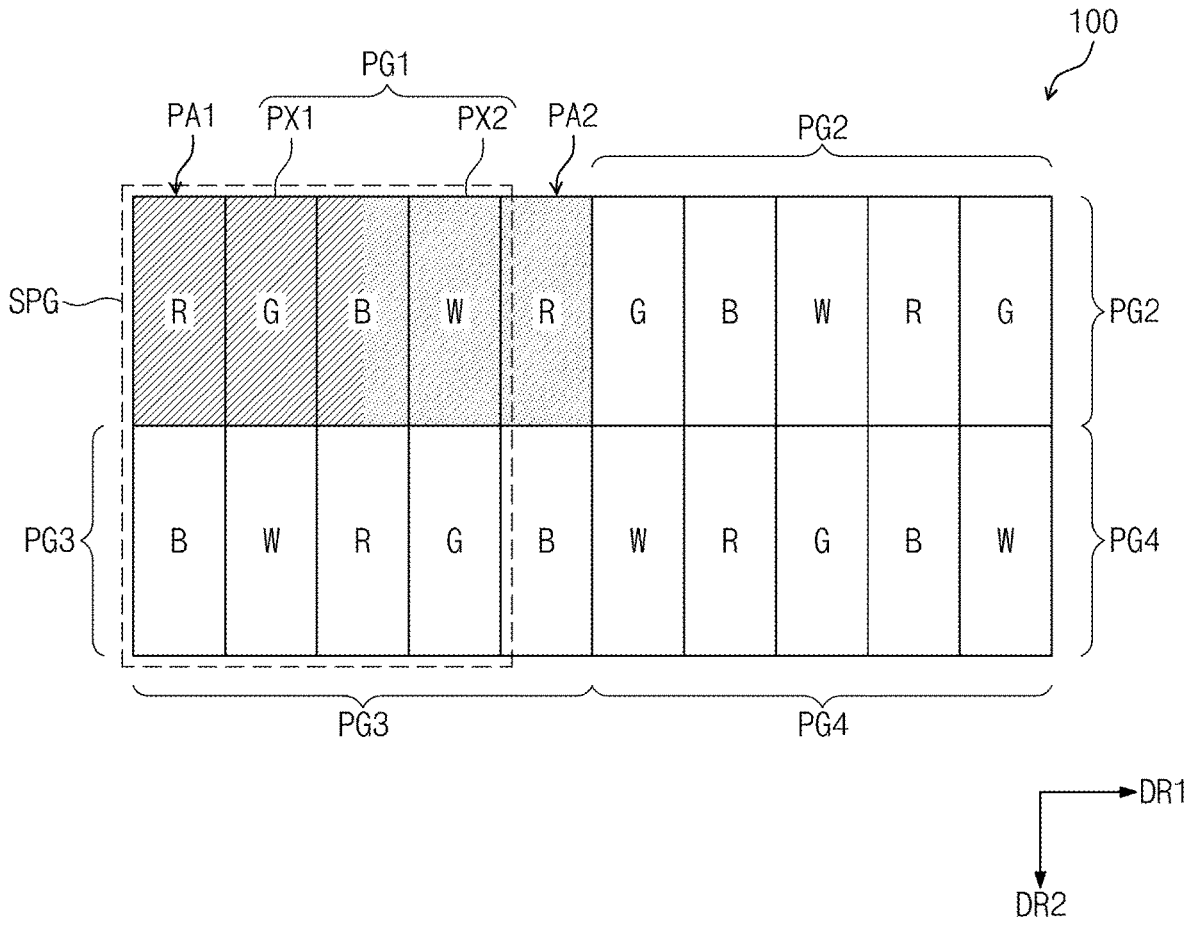
FIG. 2 is a view illustrating a portion of a display panel of FIG. 1 according to an embodiment of the inventive concept.

FIG. 2 is a view illustrating a portion of a display panel of FIG. 1 according to an embodiment of the inventive concept.

Referring to FIG. 2, the display panel 100 may include a plurality of sub-pixels R, G, B, and W. Each of the sub-pixels R, G, B, and W may display one of primary colors. In an embodiment, the primary colors may include red, green, blue, and white. Accordingly, the sub-pixels R, G, B, and W may include a red sub-pixel R, a green sub-pixel G, a blue sub-pixel B, and a white sub-pixel W. However, the inventive concept is not limited thereto, and thus the primary colors may further include various colors, such as yellow, cyan, and magenta.

In FIG. 2, the sub-pixels R, G, B, and W may be repeatedly arranged in units of a sub-pixel group SPG including 8 sub-pixels that are arranged in a 2×4 matrix. The sub-pixel group SPG may include two red sub-pixels R, two green sub-pixels, two blue sub-pixels B, and two white sub-pixels W.

In FIG. 2, of the sub-pixel group SPG, sub-pixels in a first row may be arranged in a first direction DR1 in the order of a red sub-pixel R, a green sub-pixel G, a blue sub-pixel B, and a white sub-pixel W. In addition, of the sub-pixel group SPG, sub-pixels in a second row may be arranged in the first direction DR1 in the order of a blue sub-pixel B, a white sub-pixel W, a red sub-pixel R, and a green sub-pixel G. However, the inventive concept is not limited thereto, and the color arrangement of the sub-pixels in the sub-pixel group SPG may be changed.

The display panel 100 may include pixel groups PG1 to PG4. Each of the pixel groups PG1 to PG4 may include two pixels that are adjacent to each other. FIG. 2 illustrates, as an example, the 4 pixel groups PG1 to PG4. The pixel groups PG1 to PG4 may have the same structure, except for color arrangement of sub-pixels. A first pixel group PG1 will be described below as an example.

The first pixel group PG1 may include a first pixel PX1 and a second pixel PX2, which are adjacent to each other in the first direction DR1. In FIG. 2, the first pixel PX1 and the second pixel PX2 are shown in different hatched patterns.

The display panel 100 includes a plurality of pixel areas PA1 and PA2, and pixels PX1 and PX2 are disposed in the pixel areas PA1 and PA2, respectively. The pixels PX1 and PX2 are shown by different shadings in FIG. 2, each including 2.5 pixels to conceptually depict that the center pixel is shared by the adjacent pixels PX1 and PX2. The pixels PX1 and PX2 are each a unit element that determines a resolution of the display panel 100, and the pixel areas PA1 and PA2 are areas where respective pixels are disposed. Each of the pixel areas PA1 and PA2 is an area that may display three different colors.

Each of the pixel areas PA1 and PA2 may be set as an area having a ratio of length in a second direction DR2 to length in a first direction DR1 of 1:1 (hereinafter, referred to as an aspect ratio). One pixel may include a portion of one sub-pixel according to a shape (aspect ratio) of the set pixel area. According to an embodiment of the inventive concept, one independent sub-pixel (as an example, the blue sub-pixel B of the first pixel group PG1) is not included in one pixel, and a portion of one independent sub-pixel (as an example, the blue sub-pixel B of the first pixel group PG1) may be included in one pixel.

The first pixel PX1 is disposed in the first pixel area PA1, and the second pixel PX2 is disposed in the second pixel area PA2. In FIG. 2, the first pixel area PA1 and the second pixel area PA2 are shown by different shadings. The first pixel area PA1 is the area that is occupied by the first pixel PX1, and the second pixel area PA2 is the area that is occupied by the second pixel PX2.

Five sub-pixels R, G, B, W, and R may be disposed in the first pixel area PA1 and the second pixel area PA2.

Each of the sub-pixels R, G, B, W, and R may be included in any one pixel group PG1 among the pixel groups PG1 to PG4. That is, the pixel Groups PG1 to PG4 include mutually exclusive sub-pixels of sub-pixels R, G, B, W, and R.

A third sub-pixel (B; hereinafter referred to as a shared sub-pixel) in the first direction DR1 among the sub-pixels R, G, B, W, and R may overlap the first pixel area PA1 and the second pixel area PA2. PA1 is the area occupied by PX1. That is, the shared sub-pixel B may be disposed at the center of the sub-pixels R, G, B, W, and R included in the first pixel PX1 and the second PX2, and may be part of both the first pixel area PA1 and the second pixel area PA2.

The first pixel PX1 and the second pixel PX2 may share the shared sub-pixel B. The first pixel PX1 and the second pixel PX1 "sharing" the shared sub-pixel B means that blue data applied to the shared sub-pixel B is data generated based on first blue data corresponding to the first pixel PX1 among the input data RGB and second blue data corresponding to the second pixel PX2 among the input data RGB.

Likewise, two pixel areas included in each of the second to fourth pixel groups PG2 to PG4 may share one shared sub-pixel. A shared sub-pixel of the first pixel group PG1 may be a blue sub-pixel B, a shared sub-pixel of the second pixel group PG2 may be a white sub-pixel W, a shared sub-pixel of the third pixel group PG3 may be a red sub-pixel R, and a shared sub-pixel of the fourth pixel group PG4 may be a green sub-pixel G as the shared sub-pixel is usually in the center of the group.

That is, the display panel 100 includes the pixel groups PG1 to PG4, each of which includes two adjacent pixels PX1 and PX2, and the two pixels (e.g., PX1 and PX2) of each pixel group PG1 to PG4 may share a sub-pixel (e.g., B).

The first pixel PX1 and the second pixel PX2 may be driven during the same horizontal scan period. The horizontal scan period may be defined as a pulse-on period of one gate signal. That is, the first pixel PX1 and the second pixel PX2 may be connected to the same gate line and driven by the same gate signal. Likewise, the first pixel group PG1 and the second pixel group PG2 may be driven during the same first horizontal scan period, and the third pixel group PG3 and the fourth pixel group PG4 may be driven during the same second scan horizontal scan period.

In an embodiment of the inventive concept, each of the first pixel PX1 and the second pixel PX2 may include 2.5 sub-pixels. Specifically, the first pixel PX1 may include the red sub-pixel R, the green sub-pixel G, and one half share of the blue sub-pixel B in the first direction DR1. The second pixel PX2 may include the other half share of the blue sub pixel B, the white sub-pixel W, and the red sub-pixel R in the first direction DR1.

As mentioned above, however, this "sharing" of the center sub pixel is temporal, not physical. While FIG. 2 depicts the shared subpixel as being divided into half, this does not mean that a blue signal for the first pixel PX1 only activates half of the shared sub-pixel. In an embodiment of the inventive concept, sub-pixels included in each of the first pixel PX1 and the second pixel PX2 may display three different colors. The first pixel PX1 may display red, green, and blue, and the second pixel PX2 may display blue, white, and red. However, only one of the first pixel PX1 and the second pixel PX2 can activate the blue shared sub-pixel at a time.

In an embodiment of the inventive concept, the number of sub-pixels is 2.5 times the number of pixels. For example, the two pixels PX1 and PX2 may include five sub-pixels R, G, B, W, and R. In other words, the five sub-pixels R, G, B, W, and R may be disposed in the first pixel area PA1 and the second pixel area PA2 where two pixels, that is, the first pixel PX1 and the second pixel PX2 are disposed.

Figure 3:
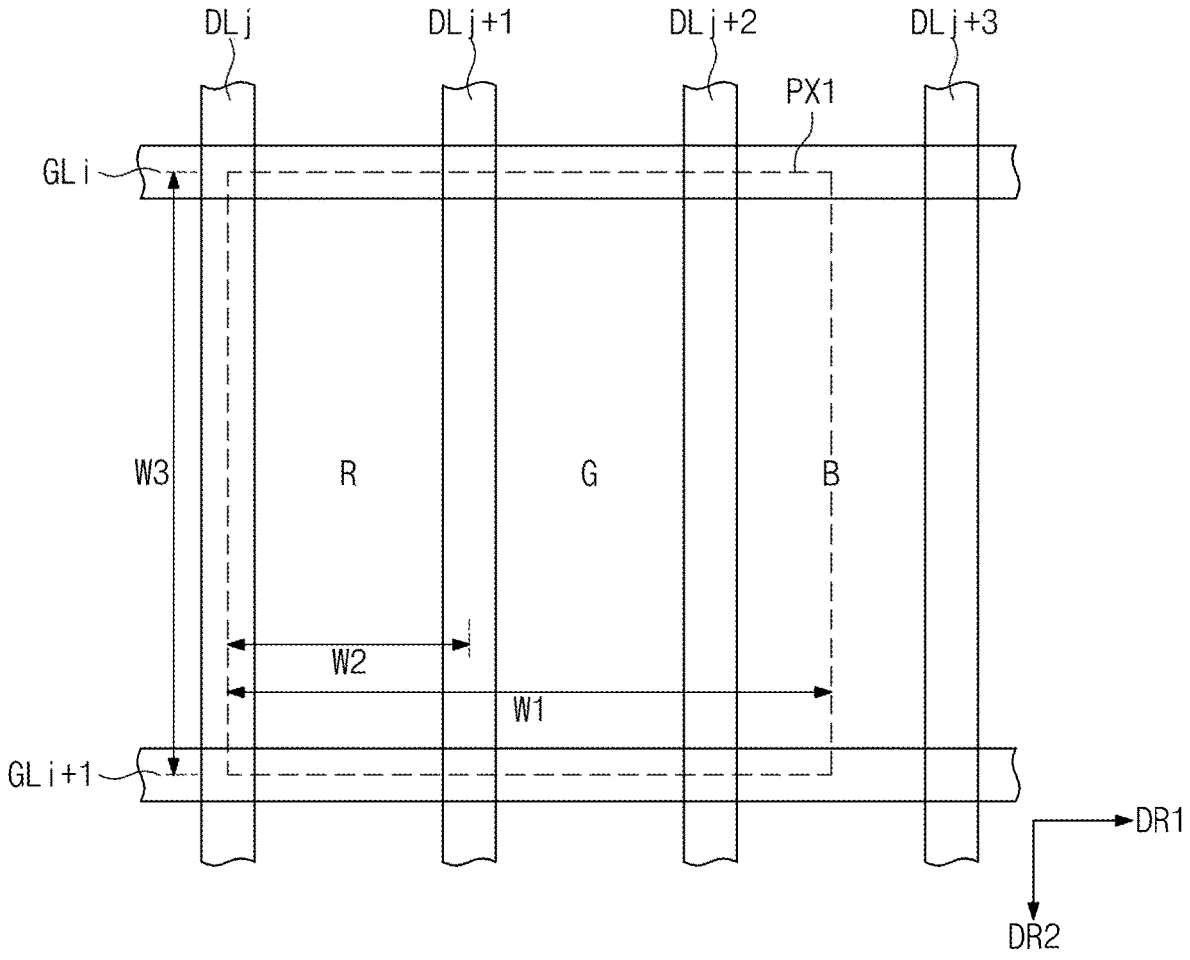
FIG. 3 is an enlarged view illustrating a first pixel of FIG. 2 and surroundings thereof.

FIG. 3 is an enlarged view illustrating a first pixel PX1 of FIG. 2 and its surroundings. FIG. 3 illustrates data lines DLj to DLj+3 ($1 \leq j < m$) that are adjacent in a first direction DR1 and gate lines GLi and GLi+1 ($1 \leq j < k$) that are adjacent in a second direction DR2. In FIG. 3, each of areas partitioned by the data lines DLj to DLj+3 ($1 \leq j < m$) and the gate lines GLi and GLi+1 ($1 \leq j < k$) may include a thin-film transistor and an electrode connected with the thin-film transistor, which are not shown herein.

Referring to FIGS. 2 and 3, an aspect ratio (a length W1 in the first direction DR1 versus a length W3 in the second direction DR2) of each of the first pixel PX1 and the second pixel PX2 may be substantially 1:1. The term "substantially" used herein means within a 5% variation, e.g., due to an error in a process. Since the pixels PX1 and PX2 have the same shape, the first pixel PX1 will be described below as an example.

The length W1 of the first pixel PX1 in the first direction DR1 may be defined to be 2.5 times the distance W2 between a middle of a width of a jth data line DLj in the first direction DR1 and a middle of a width of a (j+1)th data line DLj+1 in the first direction DR1. In other words, the length W1 of the first pixel PX1 in the first direction DR1 may be a sum of a distance between the middle of the width of the jth data line DLj in the first direction DR1 and a middle of a width of a (j+2)th data line DLj+2 in the first direction DR1 and a half of a distance between the middle of the width of the (j+2)th data line DLj+2 in the first direction DR1 and a middle of a width of a (j+3)th data line DLj+3 in the first direction DR1. However, the inventive concept is not limited thereto, and the length W1 of the first pixel PX1 in the first direction DR1 may be defined as half of a distance between the middle of the width of the jth data line DLj in the first direction DR1 and a middle of a width of a (j+6)th data line DLj+6 in the first direction DR1.

A length W3 of the first pixel PX1 in the second direction DR2 may be defined as a distance between a middle of a width of an ith gate line GLi in the second direction DR2 and a middle of a width of an (i+1)th gate line GLi+1 in the second direction DR2. However, the inventive concept is not limited thereto, and the length W3 of the first pixel PX1 in the second direction DR2 may be defined as a half of a distance between the middle of the width of the ith gate line GLi in the second direction DR2 and a middle of a width of an (i+2)th gate line in the second direction DR2.

Figure 4:
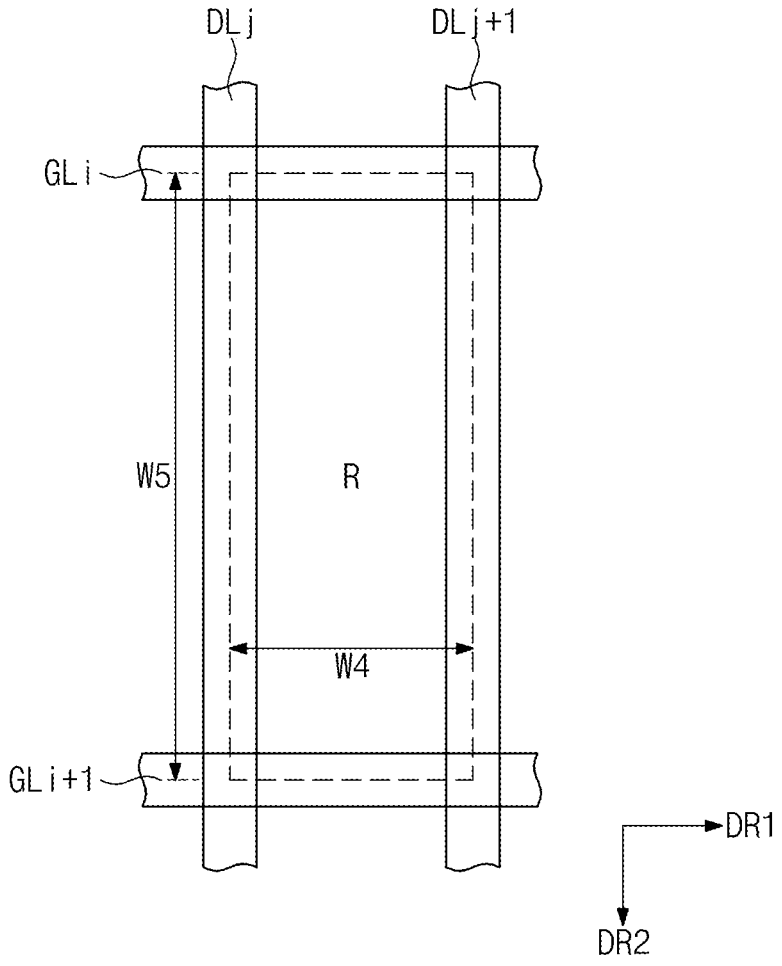
FIG. 4 is an enlarged view illustrating one sub-pixel (red sub-pixel) and surroundings thereof.

FIG. 4 is an enlarged view illustrating one sub-pixel (red sub-pixel) and its surroundings. FIG. 4 illustrates data lines DLj and DLj+1 ($1 \leq j < m$) that are adjacent in the first direction DR1 and gate lines GLi and GLi+1 ($1 \leq j < k$) that are adjacent in the second direction DR2. In FIG. 4, an area partitioned by the data lines DLj and DLj+1 ($1 \leq j < m$) and the gate lines GLi and GLi+1 ($1 \leq j < k$) may include a thin-film transistor and an electrode connected with the thin-film transistor, which are not shown herein.

Referring to FIGS. 2 and 4, an aspect ratio (a length W4 in the first direction DR1 versus a length W5 in the second direction DR2) of each of sub-pixels R, G, B, and W may be substantially 1:2.5. The term "substantially," as used herein, means within a 5% variation due to an error in a process. Since the sub-pixels R, G, B, and W have the same shape, a red sub-pixel R will be described below as an example.

A length W4 of the red sub-pixel R in the first direction DR1 may be defined as a distance W4 between the middle of the width of the jth data line DLj in the first direction DR1 and the middle of the width of the (j+1)th data line DLj+1 in the first direction DR1. However, the inventive concept is not limited thereto, and the length W4 of the red sub-pixel R in the first direction DR1 may be defined as a half of a distance between the middle of the width of the jth data line DLj in the first direction DR1 and a middle of a width of a (j+2)th data line in the first direction DR1.

A length W5 of the red sub-pixel R in the second direction DR2 may be defined as a distance between a middle of a width of an ith gate line GLi in the second direction DR2 and a middle of a width of an (i+1)th gate line GLi+1 in the second direction DR2. However, the inventive concept is not limited thereto, and the length W5 of the red sub-pixel R in the second direction DR2 may be defined as half of a distance between the middle of the width of the ith gate line GLi in the second direction DR2 and a middle of a width of an (i+2)th gate line in the second direction DR2.

Referring again to FIGS. 2 to 4, sub-pixels that are arranged in a 2×5 matrix may substantially form a square. That is, each set of the sub-pixels included in the first pixel group PG1 and the third pixel group PG3 may substantially form a square.

In addition, an aspect ratio of each of the pixel groups PG1 to PG4 may be 2:1. When the first pixel group PG1 is described as an example, the first pixel group PG1 may include five sub-pixels R, G, B, W, and R. An aspect ratio of each of the sub-pixels R, G, B, W, and R included in the first pixel group PG1 may be substantially 2:n. In an embodiment of FIG. 2, since n is 5, the aspect of the sub-pixels R, G, B, W, and R may be 1:2.5.

With the display apparatus according to an embodiment of the inventive concept, the number of data lines may be reduced to ⅖ of the number of data lines of an RGB-stripe structure while representing the same resolution as the RGB-stripe structure because one pixel includes 2.5 sub-pixels. As the number of data lines decreases, a configuration of the data driver (400 of FIG. 1) may be simplified, thereby saving a production cost of the data driver (400 of FIG. 1). In addition, as the number of data lines decreases, an aperture ratio may also increase.

With the display apparatus according to an embodiment of the inventive concept, since one pixel may display three colors, the pixel may have a higher color reproduction even when the pixel has the same resolution as a structure including two of the sub-pixels R, G, B, and W.

Figure 5:
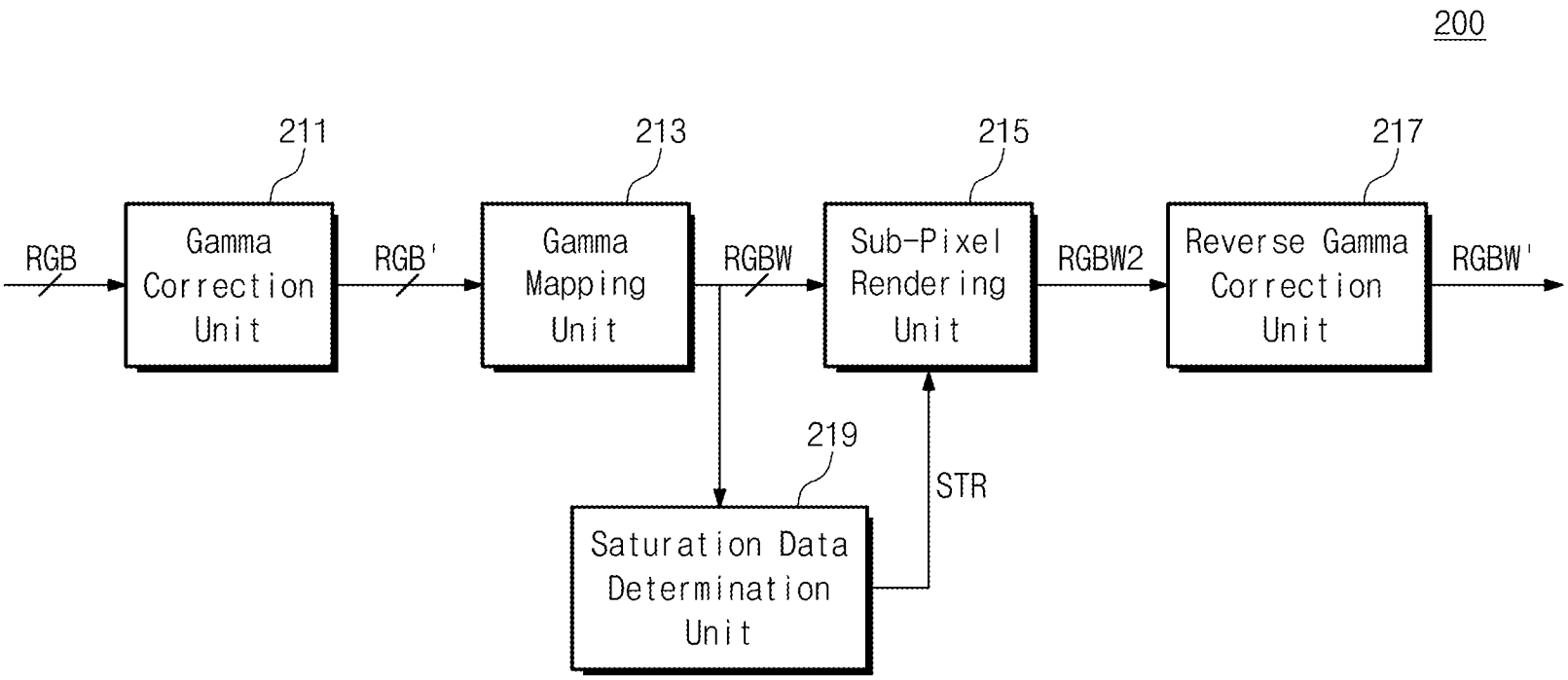
FIG. 5 is a block diagram illustrating a timing controller of FIG. 1.

FIG. 5 is a block diagram illustrating a timing controller of FIG. 1.

Referring to FIG. 5, the timing controller 200 includes a gamma correction unit 211, a gamut mapping unit 213, a sub-pixel rendering unit 215, a reverse gamma correction unit 217, and a saturation data determination unit 219.

The gamma correction unit 211 receives input data RGB having red data, green data, and blue data. In general, the input data RGB has a nonlinear property. The gamma correction unit 211 applies a gamma function to the input data RGB having the nonlinear property to linearize the input data RGB. The gamma correction unit 211 generates the linearized input data RGB' based on the input data RGB having the nonlinear property in order to allow subsequent blocks (the gamut mapping unit and the sub-pixel rendering unit) to easily process data. The linearized input data RGB' is provided to the gamut mapping unit 213.

The gamut mapping unit 213 may generate the RGBW data RGBW having red, green, blue, and white data based on the linearized input data RGB'. The gamut mapping unit 213 may generate the RGBW data RGBW by using a gamut mapping algorithm (GMA) to map an RGB gamut of the linearized input data RGB' to an RGBW gamut. The RGBW data RGBW may be provided to the sub-pixel rendering unit 215. The gamut mapping unit 213 may further generate luminance data of the linearized input data RGB' other than the RGBW data RGBW. The luminance data may be used to determine luminance of a backlight unit (not shown).

The sub-pixel rendering unit 215 performs a rendering operation on the RGBW data RGBW to generate rendering data RGBW2 corresponding to each of the sub-pixels R, G, B, and W. The RGBW data RGBW has data regarding four colors composed of red, green, blue, and white corresponding to respective pixel areas. However, in an embodiment of the inventive concept, one pixel has 2.5 sub-pixels (including the shared sub-pixel) that display three different colors, and thus the rendering data RGBW2 may have data regarding three of red, green, blue, and white corresponding to respective pixels. The sub-pixel rendering unit 215 will be described below in detail.

The rendering data RGBW2 is provided to a reverse gamma correction unit 217. The reverse gamma correction unit 217 performs reverse gamma correction on the rendering data RGBW2 to convert the rendering data RGBW2 into a non-linearized RGBW data RGBW' prior to gamma correction. A data format of the non-linearized RGBW data RGBW' is converted appropriately according to a specification of the data driver 400 and is then provided to the data driver 400 as output data RGBWf.

The saturation data determination unit 219 receives the RGBW data RGBW from the gamut mapping unit 213, and analyzes the RGBW data RGBW for each piece of unit pixel data corresponding to each pixel to thereby generate a saturation signal STR having information regarding whether to have saturated color data. The saturation data determination unit 219 determines that the unit pixel data includes saturated color data when red data, green data, or blue data included in the unit pixel data corresponding to one pixel has a gray scale value equal to or greater than a preset level. The saturation data determination unit 219 outputs the saturation signal STR to the sub-pixel rendering unit 215.

Figure 6:
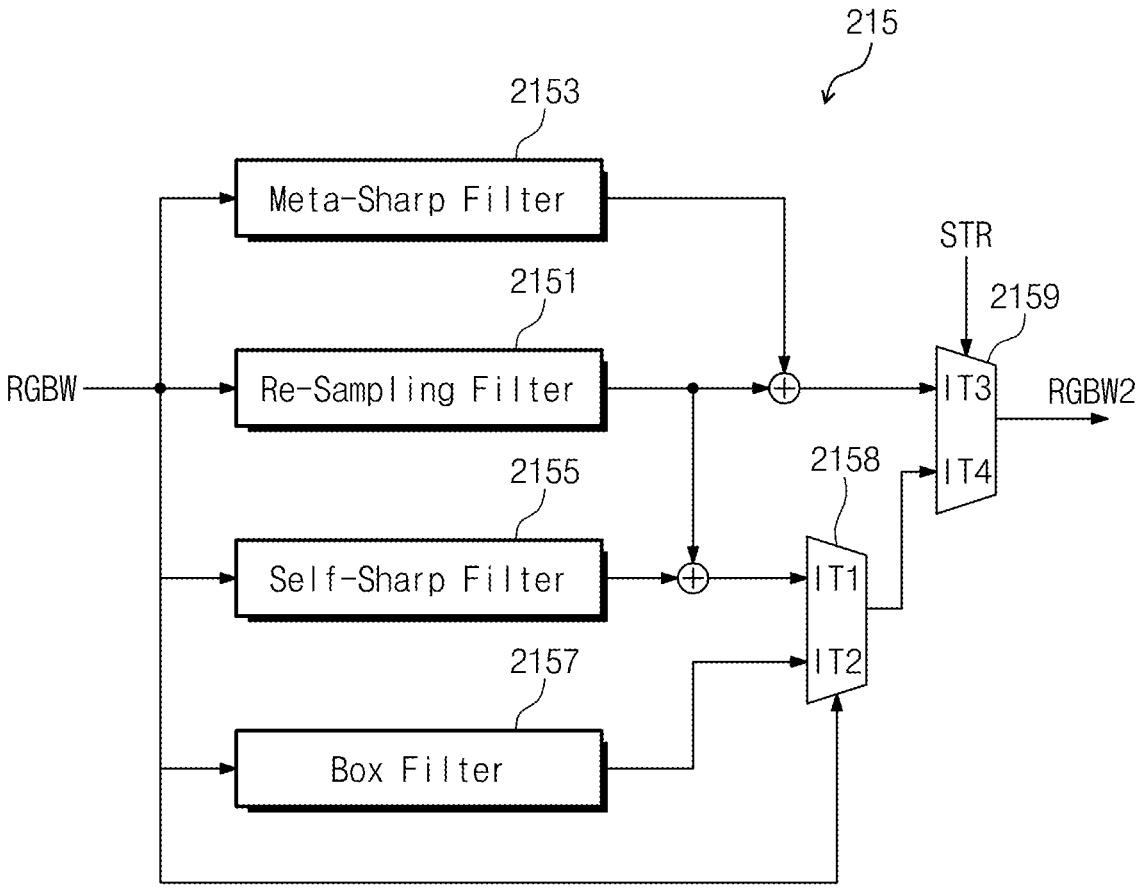
FIG. 6 is a block diagram illustrating a sub-pixel rendering unit of FIG. 5.

FIG. 6 is a block diagram illustrating the sub-pixel rendering unit of FIG. 5.

Referring to FIG. 6, the sub-pixel rendering unit 215 includes a re-sampling filter 2151, a meta-sharp filter 2153, a self-sharpening filter 2155, a box filter 2157, a pattern detection filter 2158, and a saturated color detection filter 2159.

The re-sampling filter 2151 is a filter for generating data corresponding to a target pixel among the rendering data RGBW2, based on data corresponding to a target pixel and surrounding pixels adjacent to the target pixel among the RGBW data RGBW. The target pixel may be defined as one pixel on which calculation or detection is to be performed. A filter coefficient of the re-sampling filter 2151 may be determined in consideration of a structure of the display panel 100 of FIG. 2 and sizes and positions of sub-pixels. A detailed description thereof will be described below.

The meta-sharp filter 2153 is a filter for compensating for distortion by applying the re-sampling filter 2151 to a specific pattern of the RGBW data RGBW. The meta-sharp filter 2153 may perform sharpening process on a pattern composed of a white color and a black color to correct the distortion such that the pattern is substantially the same as before passing the re-sampling filter 2151. For the data that has passed the meta-sharp filter 2153, blurring of a white pattern may be alleviated.

The self-sharpening filter 2155 is a filter for compensating for distortion by applying the re-sampling filter 2151 to a horizontal line pattern or vertical line pattern including a red, green, or blue color of the RGBW data RGBW. The self-sharpening filter 2155 may perform sharpening process on the horizontal line pattern or vertical line pattern including the red, green, or blue color to produce a pattern that is substantially the same as that before passing the re-sampling filter 2151.

The box filter 2157 is a filter for correcting a dot pattern or diagonal pattern including the red, green, or blue color of the RGBW data RGBW. The box filter 2157 may correct the signal such that the dot pattern or diagonal pattern including the red, green, or blue color may be appropriately represented in the structure of the display panel 100 of FIG. 2.

The pattern detection filter 2158 includes a first input terminal IT1 and a second input terminal IT2. The pattern detection filter 2158 analyzes the RGBW data RGBW and selectively outputs any one of data received through the first input terminal T1 and the second input terminal IT2 according to whether the dot pattern or diagonal pattern is detected.

Data obtained by adding the data obtained by applying the re-sampling filter 2151 to the RGBW data RGBW and the data obtained by applying the self-sharp filter 1255 to the RGBW data RGBW is input to the first input terminal IT1 of the pattern detection filter 2158. Data obtained by adding the box filter 2157 to the RGBW data RGBW is input to the second input terminal IT2 of the pattern detection filter 2158.

The pattern detection filter 2158 outputs data corresponding to the target pixel input to the second input terminal (IT2) when data corresponding to the target pixel among the RGBW data RGBW has a dot pattern or diagonal pattern. The pattern detection filter 2158 outputs data corresponding to the target pixel input to the first input terminal (IT1) when the RGBW data RGBW corresponding to the target pixel does not have a dot pattern or diagonal pattern.

The saturated color detection filter 2159 includes a third input terminal IT3 and a fourth input terminal IT4. The saturated color detection filter 2159 analyzes the saturation signal STR and selectively outputs any one of data received through the third input terminal IT3 and the fourth input terminal IT4 according to whether a saturated color is detected.

Data, which is obtained by adding the data obtained by applying the re-sampling filter 2151 to the RGBW data RGBW and the data obtained by applying the meta-sharp filter 2153 to the RGBW data RGBW is input to the third input terminal IT3 of the saturated color detection filter 2159. The data output from the pattern detection filter 2158 is input to the fourth input terminal IT4 of the saturated color detection filter 2159.

The saturated color detection filter 2159 outputs data input to the fourth input terminal IT4 when the data corresponding to the target pixel among the RGBW data RGBW has the saturated color. The saturated color detection filter 2159 outputs data input to the third input terminal IT3 when the data corresponding to the target pixel among the RGBW data RGBW does not have a saturated color.

The data output from the saturated color detection filter 2159 is output as the rendering data RGBW2.

Figure 7:
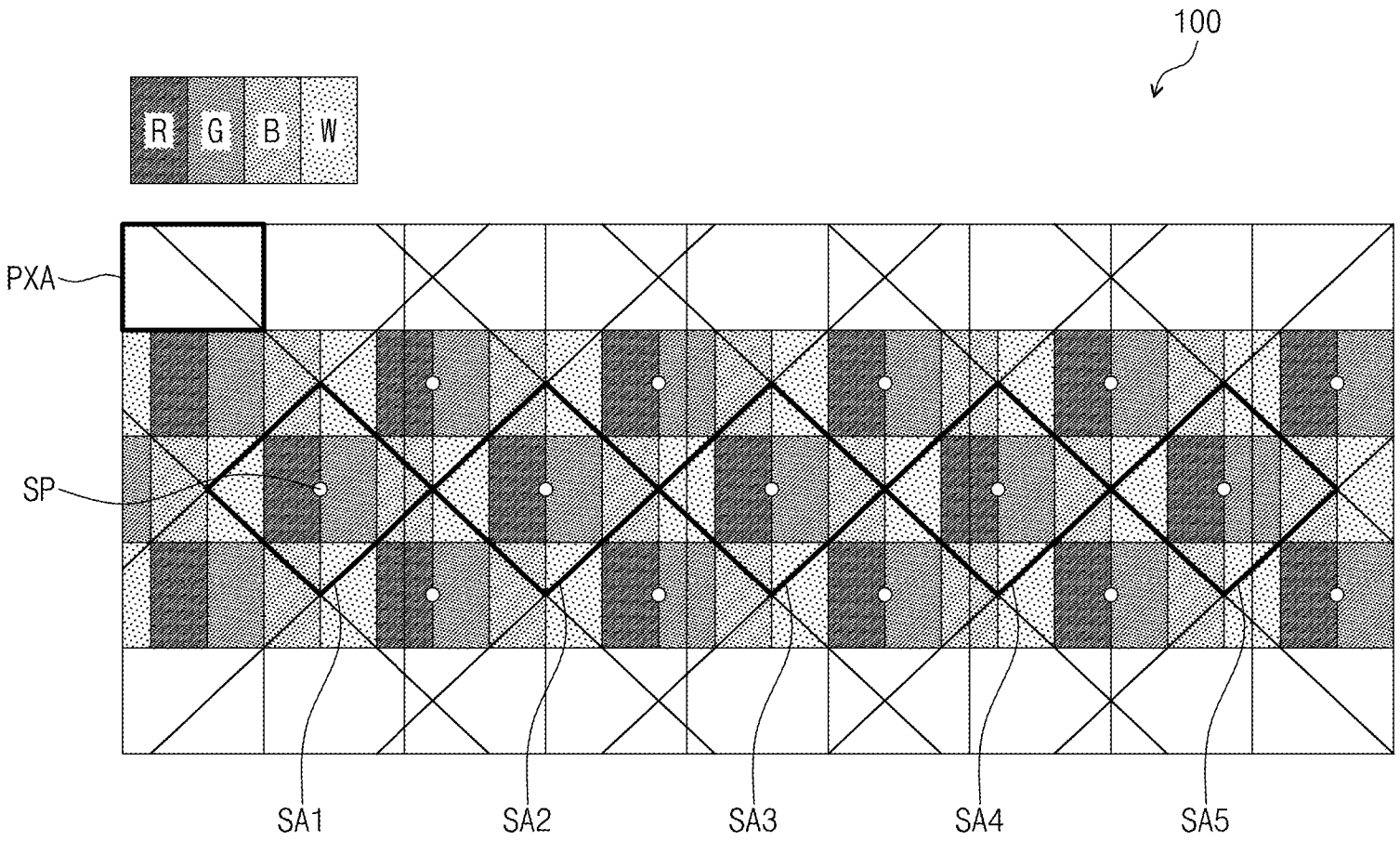
FIG. 7 is a view illustrating a re-sampling area in a display panel.
Figure 8:
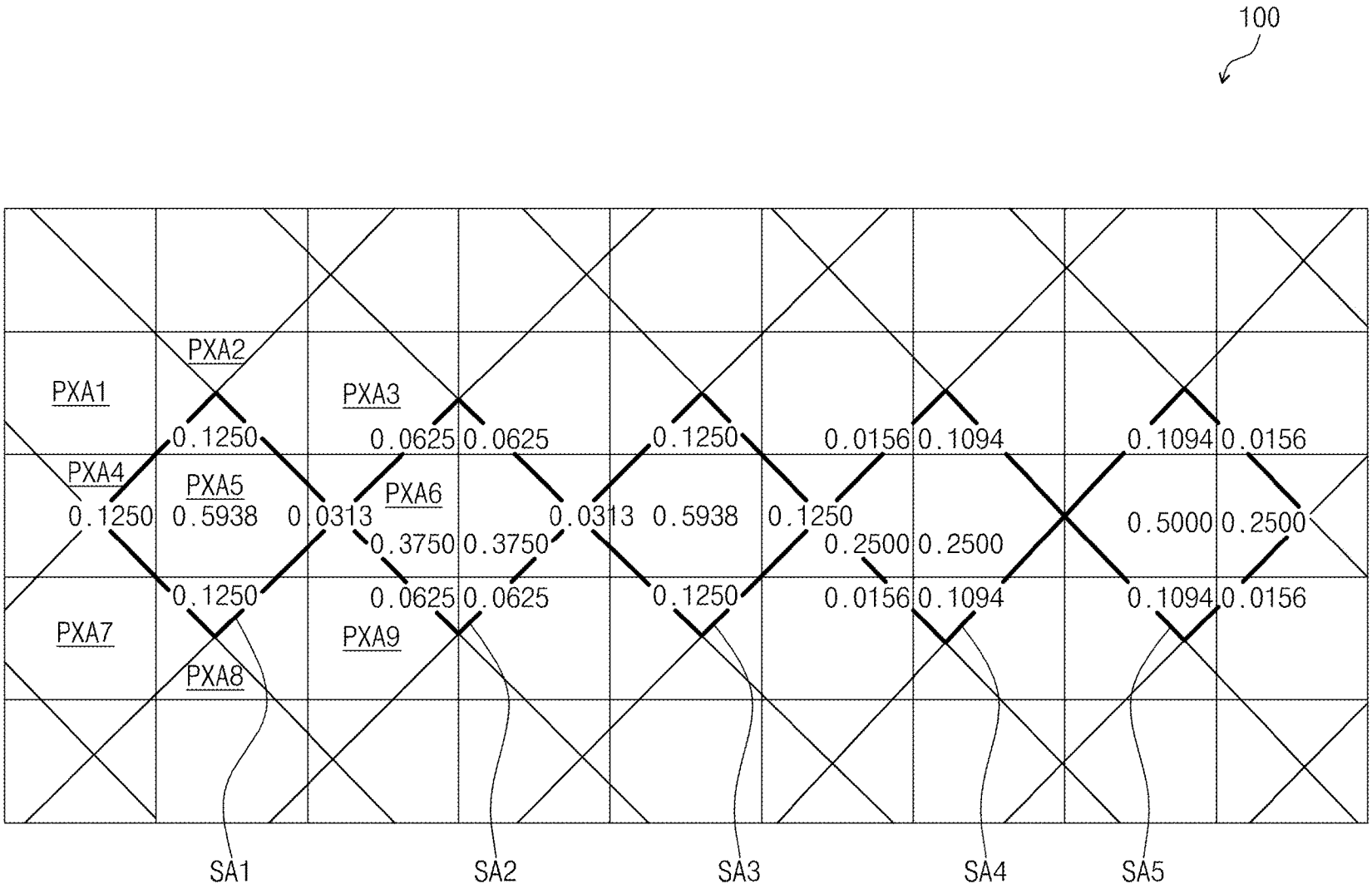
FIG. 8 is a view illustrating proportions of the re-sampling area of FIG. 7 that are occupied by pixel areas adjacent thereto.

FIG. 7 is a view illustrating a re-sampling area in the display panel 100, and FIG. 8 is a view illustrating proportions of the re-sampling area of FIG. 7 that are occupied by pixel areas adjacent thereto. FIGS. 7 and 8 illustrate re-sampling areas SA1 to SA5 for red and green sub-pixels, and a pixel area PXA occupied by one pixel. FIG. 7 illustrates that red, green, blue, and white sub-pixels are indicated using different hatched lines, and illustrates sub-pixels corresponding to the respective hatched lines in a legend.

Referring to FIG. 7, a re-sampling point (SP) is set between the red sub-pixel and the green sub-pixel. The re-sampling areas SA1 to SA5 which are to be covered by the red sub-pixel and the green sub-pixels adjacent thereto are set based on the re-sampling point SP.

Each of the re-sampling areas SA1 to SA5 may be set to have the same area as the combined area of four sub-pixels. The re-sampling areas SA1 to SA5 may be set to have the same area as one another. Each of the re-sampling areas SA1 to SA5 may be set to have an approximately rhombic shape. The re-sampling areas SA1 to SA5 may include first to fifth re-sampling areas SA1 to SA5 according to the position of the re-sampling point SP in the pixel area PA.

Referring to FIG. 8, it is possible to show proportions of each of the first to fifth re-sampling areas SA1 to SA5 that are overlapped by pixel areas adjacent thereto. In FIG. 8, each of the first to fifth re-sampling areas SA1 to SA5 is indicated as a hatched line. Respective proportions of the first re-sampling area SA1 that first to nine pixel areas PXA1 to PXA9 occupy will be described as an example. The first to ninth pixel regions PXA1 to PXA9 overlap or are adjacent to, the first re-sampling area SA1, and arranged in the form of a 3×3 matrix.

When an area of the first re-sampling area SA1 is assumed to be 1, each of the second pixel area (PXA2), the fourth pixel area PXA4, and the eighth pixel area PXA8 occupies 0.125 of the first re-sampling area SA1. The fifth pixel area PXA5 occupies 0.5938 of the first re-sampling area SA1, and the sixth pixel area PXA6 occupies 0.0313 of the first re-sampling area SA1.

FIG. 9A is a view illustrating a first re-sampling filter RF1 having filter coefficients that are determined according to the proportions of the first re-sampling area SA1 that the pixel areas occupy. FIGS. 9B to 9E illustrate the second to fifth re-sampling filters RF2 to RF5 having filter coefficients that are determined according to the proportions of the second to fifth re-sampling areas SA2 to SA5 that the pixel areas occupy, as similar to the first re-sampling filter RF1.

FIGS. 9A to 9E illustrate that each of the first to fifth re-sampling filters has filter coefficients, a total sum of which is equal to 256. However, the inventive concept is not limited thereto, and the total sum may vary because the filter coefficients of each of the first to fifth re-sampling filters RF1 to RF5 are meaningful as ratios therebetween. For example, the total sum of the coefficients of each of the first to fifth re-sampling filters RF1 to RF5 may be equal to 1 or may be greater than 256.

The first re-sampling filter RF1 may have filter coefficients arranged in the form of a 3×3 matrix. In the first re-sampling filter RF1, a filter coefficient in first row and first column may be 0, a filter coefficient in first row and second column may be 32, a filter coefficient in first row and third column may be 0, a filter coefficient in second row and first column may be 32, a filter coefficient in second row and second column may be 152, a filter coefficient in second row and third column may be 8, a filter coefficient in third row and first column may be 0, a filter coefficient in third row and second column may be 32, and a filter coefficient in third row and third column may be 0.

The second re-sampling filter RF2 may have filter coefficients arranged in the form of a 3×2 matrix. In the second re-sampling filter RF2, a filter coefficient in first row and first column may be 16, a filter coefficient in first row and second column may be 16, a filter coefficient in second row and first column may be 96, a filter coefficient in second row and second column may be 96, a filter coefficient in third row and first column may be 16, and a filter coefficient in third row and second column may be 16.

The third re-sampling filter RF3 may have filter coefficients arranged in the form of a 3×3 matrix. In the third re-sampling filter RF3, a filter coefficient in first row and first column may be 0, a filter coefficient in first row and second column may be 32, a filter coefficient in first row and third column may be 0, a filter coefficient in second row and first column may be 8, a filter coefficient in second row and second column may be 152, a filter coefficient in second row and third column may be 32, a filter coefficient in third row and first column may be 0, a filter coefficient in third row and second column may be 32, and a filter coefficient in third row and third column may be 0.

The fourth re-sampling filter RF4 may have filter coefficients arranged in the form of a 3×2 matrix. In the fourth re-sampling filter RF4, a filter coefficient in first row and first column may be 4, a filter coefficient in first row and second column may be 28, a filter coefficient in second row and first column may be 64, a filter coefficient in second row and second column may be 128, a filter coefficient in third row and first column may be 4, and a filter coefficient in third row and second column may be 28.

The fifth re-sampling filter RF5 may have filter coefficients arranged in the form of a 3×2 matrix. In the fifth re-sampling filter RF5, a filter coefficient in first row and first column may be 28, a filter coefficient in first row and second column may be 4, a filter coefficient in second row and first column may be 128, a filter coefficient in second row and second column may be 64, a filter coefficient in third row and first column may be 28, and a filter coefficient in third row and second column may be 4.

The first to fifth re-sampling filters RF1 to RF5 illustrated in FIGS. 9A to 9E are filters that are derived when a re-sampling point SP is set between the red sub-pixel and the green sub-pixel. Although not illustrated in FIGS. 7 and 8, filters derived when the re-sampling point SP is set between the blue sub-pixel and the white sub-pixel are the same as the first to fifth re-sampling filters RF1 to RF5 illustrated in FIGS. 9A to 9E, except for the order of derivation.

The fourth re-sampling filter RF4 of FIG. 9D is derived from a re-sampling area of a blue sub-pixel and a white sub-pixel that is to be set between the first re-sampling area SA1 and the second re-sampling area SA2. The fifth re-sampling filter RF5 of FIG. 9E is derived from a re-sampling area of a blue sub-pixel and a white sub-pixel that is to be set between the second re-sampling area SA2 and the third re-sampling area SA3. The first re-sampling filter RF1 of FIG. 9A is derived from a re-sampling area of a blue sub-pixel and a white sub-pixel that is to be set between the third re-sampling area SA3 and the fourth re-sampling area SA4. The second re-sampling filter RF2 of FIG. 9B is derived from a re-sampling area of a blue sub-pixel and a white sub-pixel that is to be set between the fourth re-sampling area SA4 and the fifth re-sampling area SA5. The third re-sampling filter RF3 of FIG. 9C is derived from a re-sampling area of a blue sub-pixel and a white sub-pixel that is to be set between the fifth re-sampling area SA5 and the sixth re-sampling area SA6 (not shown).

FIGS. 10A to 10E are views illustrating first to fifth meta-sharp filters MF1 to MF5.

Referring to FIGS. 6 and 10A to 10E, the meta-sharp filter 1253 may include the first to fifth meta-sharp filters MF1 to MF5.

FIGS. 10A to 10E illustrate that the first to fifth meta-sharp filters MF1 to MF5 may each have filter coefficients, a total sum of which is equal to 0.

The first to fifth meta-sharp filters MF1 to MF5 may have the same matrix as the first to fifth re-sampling filters RF1 to RF5 illustrated in FIGS. 9A to 9E, respectively.

In the first meta-sharp filter MF1, a filter coefficient in first row and first column may be 0, a filter coefficient in first row and second column may be −32, a filter coefficient in first row and third column may be 0, a filter coefficient in second row and first column may be −32, a filter coefficient in second row and second column may be 104, a filter coefficient in second row and third column may be −8, a filter coefficient in third row and first column may be 0, a filter coefficient in third row and second column may be −32, and a filter coefficient in third row and third column may be 0.

In the second meta-sharp filter MF2, a filter coefficient in first row and first column may be −16, a filter coefficient in first row and second column may be −16, a filter coefficient in second row and first column may be −32, a filter coefficient in second row and second column may be 96, a filter coefficient in third row and first column may be −16, and a filter coefficient in third row and second column may be −16.

In the third meta-sharp filter MF3, a filter coefficient in first row and first column may be 0, a filter coefficient in first row and second column may be 32, a filter coefficient in first row and third column may be 0, a filter coefficient in second row and first column may be 8, a filter coefficient in second row and second column may be 152, a filter coefficient in second row and third column may be 32, a filter coefficient in third row and first column may be 0, a filter coefficient in third row and second column may be 32, and a filter coefficient in third row and third column may be 0.

In the fourth meta-sharp filter MF4, a filter coefficient in first row and first column may be −4, a filter coefficient in first row and second column may be −28, a filter coefficient in second row and first column may be −64, a filter coefficient in second row and second column may be 128, a filter coefficient in third row and first column may be −4, and a filter coefficient in third row and second column may be −28.

In the fifth meta-sharp filter MF5, a filter coefficient in first row and first column may be −28, a filter coefficient in first row and second column may be −4, a filter coefficient in second row and first column may be 64, a filter coefficient in second row and second column may be 0, a filter coefficient in third row and first column may be −28, and a filter coefficient in third row and second column may be −4.

The first to fifth meta-sharp filters MF1 to MF5 may be calculated corresponding to the first to fifth re-sampling filters RF1 to RF5 illustrated in FIGS. 9A to 9E, respectively. Data, which is obtained by adding data obtained by applying the first re-sampling filter RF1 among the RGBW data RGBW and data obtained by applying the first meta-sharp filter MF1 among the RGBW data RGBW, is input to the third input terminal IT3 of the saturated color detection filter 2159. Data, which is obtained by adding data obtained by applying the second re-sampling filter RF2 among the RGBW data RGBW and data obtained by applying the second meta-sharp filter MF2 among the RGBW data RGBW, is input to the third input terminal IT3 of the saturated color detection filter 2159. Data, which is obtained by adding data obtained by applying the third re-sampling filter RF3 among the RGBW data RGBW and data obtained by applying the third meta-sharp filter MF3 among the RGBW data RGBW, is input to the third input terminal IT3 of the saturated color detection filter 2159. Data, which is obtained by adding data obtained by applying the fourth re-sampling filter RF4 among the RGBW data RGBW and data obtained by applying the fourth meta-sharp filter MF4 among the RGBW data RGBW, is input to the third input terminal IT3 of the saturated color detection filter 2159. Data, which is obtained by adding data obtained by applying the fifth re-sampling filter RF5 among the RGBW data RGBW and data obtained by applying the fifth meta-sharp filter MF5 among the RGBW data RGBW, is input to the third input terminal IT3 of the saturated color detection filter 2159.

FIGS. 11A to 11E are views illustrating first to fifth self-sharpening filters SF1 to SF5.

Referring to FIGS. 6 and 11A to 11E, the self-sharp filter 2155 may include the first to fifth self-sharp filters SF1 to SF5.

FIGS. 11A to 11E show that the first to fifth self-sharp filters SF1 to SF5 may each have coefficients, a total sum of which is equal to 0.

The first to fifth self-sharpening filters SF1 to SF5 may have the same matrix size as the first to fifth re-sampling filters RF1 to RF5 shown in FIGS. 9A to 9E, respectively.

In the first self-sharpening filter SF1, a filter coefficient in first row and first column may be −16, a filter coefficient in first row and second column may be 0, a filter coefficient in first row and third column may be −16, a filter coefficient in second row and first column may be 0, a filter coefficient in second row and second column may be 40, a filter coefficient in second row and third column may be 24, a filter coefficient in third row and first column may be −16, a filter coefficient in third row and second column may be 0, and a filter coefficient in third row and third column may be −16.

In the second self-sharpening filter SF2, a filter coefficient in first row and first column may be −16, a filter coefficient in first row and second column may be −16, a filter coefficient in second row and first column may be −32, a filter coefficient in second row and second column may be 96, a filter coefficient in third row and first column may be −16, and a filter coefficient in third row and second column may be −16.

In the third self-sharpening filter SF3, a filter coefficient in first row and first column may be −20, a filter coefficient in first row and second column may be −12, a filter coefficient in first row and third column may be 0, a filter coefficient in second row and first column may be 32, a filter coefficient in second row and second column may be 0, a filter coefficient in second row and third column may be 32, a filter coefficient in third row and first column may be −20, a filter coefficient in third row and second column may be −12, and a filter coefficient in third row and third column may be 0.

In the fourth self-sharpening filter SF4, a filter coefficient in first row and first column may be −36, a filter coefficient in first row and second column may be −4, a filter coefficient in second row and first column may be 0, a filter coefficient in second row and second column may be 128, a filter coefficient in third row and first column may be −36, and a filter coefficient in third row and second column may be −4.

In the fifth self-sharpening filter SF5, a filter coefficient in first row and first column may be −28, a filter coefficient in first row and second column may be −4, a filter coefficient in second row and first column may be 0, a filter coefficient in second row and second column may be 64, a filter coefficient in third row and first column may be −28, and a filter coefficient in third row and second column may be −4.

The first to fifth self-sharpening filters SF1 to SF5 may be calculated corresponding to the first to fifth re-sampling filters RF1 to RF5 shown in FIGS. 9A to 9E, respectively. Data, which is obtained by adding data obtained by applying the first re-sampling filter RF1 among the RGBW data RGBW and data obtained by applying the first self-sharpening filter SF1 among the RGBW data RGBW, is input to the first input terminal IT1 of the pattern detection filter 2158. Data, which is obtained by adding data obtained by applying the second re-sampling filter RF2 among the RGBW data RGBW and data obtained by applying the second self-sharpening filter SF2 among the RGBW data RGBW, is input to the first input terminal IT1 of the pattern detection filter 2158. Data, which is obtained by adding data obtained by applying the third re-sampling filter RF3 among the RGBW data RGBW and data obtained by applying the third self-sharp filter SF3 among the RGBW data RGBW, is input to the first input terminal IT1 of the pattern detection filter 2158. Data, which is obtained by adding data obtained by applying the fourth re-sampling filter RF4 among the RGBW data RGBW and data obtained by applying the fourth self-sharpening filter SF4 among the RGBW data RGBW, is input to the first input terminal IT1 of the pattern detection filter 2158. Data, which is obtained by adding data obtained by applying the fifth re-sampling filter RF5 among the RGBW data RGBW and data obtained by applying the fifth self-sharpening filter SF5 among the RGBW data RGBW, is input to the first input terminal IT1 of the pattern detection filter 2158.

Figure 12:
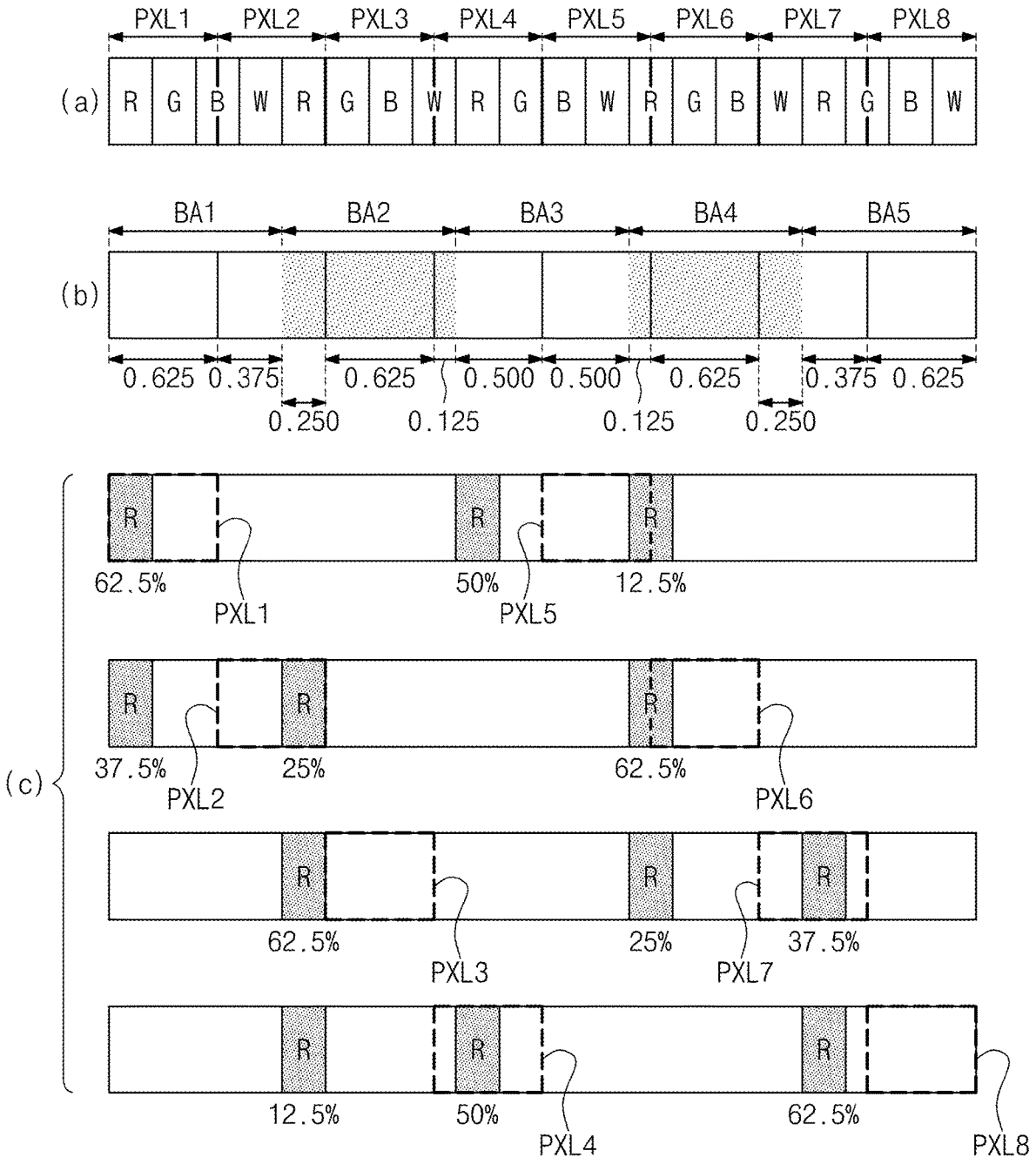
FIG. 12 is a view illustrating a process of deriving box filters.

FIG. 12 is a view illustrating a process of deriving box filters. Part (a) of FIG. 12 illustrates sub-pixels included in 8 pixels, part (b) of FIG. 12 illustrates box re-sampling areas that are set in 8 pixels, and part (c) of FIG. 12 illustrates pixels displayed when a box filter is applied in the case where unit pixel data corresponding to each pixel among the RGBW data RGBW represents a red color with the maximum grayscale.

First to eight pixels PXL1 to PXL8 illustrated in part (a) of FIG. 12 will be described as a reference. The first to eighth pixels PXL1 to PXL8 may be a portion of the display panel 100 of FIG. 2.

Referring to part (a) and part (b) of FIG. 12, a red sub-pixel, a green sub-pixel, a blue sub-pixel, and a white sub-pixel that are continuously disposed are set as one box re-sampling area. The box re-sampling area may be set to have the same area as four sub-pixels. The first to fifth box re-sampling areas BA1 to BA5 may be set in the first to eighth pixels PXL1 to PXL8.

In part (b) of FIG. 12, in order to define boundaries among the first to fifth box re-sampling areas BA1 to BA5, adjacent box re-sampling areas among the first to fifth box re-sampling areas BA1 to BA5 are differently shaded.

In addition, part (b) of FIG. 12 illustrates proportions of the first to fifth box re-sampling areas BA1 to BA5 that are respectively occupied by the first to eighth pixels PXL1 to PXL8. A proportion of the first box re-sampling area BA1 that the first pixel PXL1 occupies is 0.625, and a proportion that the first pixel PXL2 occupies is 0.375. A proportion of the second box re-sampling area BA2 that the second pixel PXL2 occupies is 0.25, a proportion that the third pixel PXL3 occupies is 0.625, and a proportion that the fourth pixel PXL4 occupies is 0.125. A proportion of the third box re-sampling area BA3 that the fourth pixel PXL4 occupies is 0.5, and a proportion that the fifth pixel PXL5 occupies is 0.5. A proportion of the fourth box re-sampling area BA4 that the fifth pixel PXL5 occupies is 0.125, a proportion that the sixth pixel PXL6 occupies is 0.625, and a proportion that the seventh pixel PXL7 occupies is 0.25. A proportion of the fifth box re-sampling area BA5 that the seventh pixel PXL7 occupies is 0.375, and a proportion that the eighth pixel PXL8 occupies is 0.625.

Referring to (c) of FIG. 12, in the case where data corresponding to the first pixel PXL1 among the RGBW data RGBW has a red color with the maximum grayscale, when the box filter is applied, the red sub-pixel in the first box re-sampling area BA1 may display 62.5% of the maximum luminance.

In the case where data corresponding to the second pixel PXL2 among the RGBW data RGBW has a red color with the maximum grayscale, when the box filter is applied, the red sub-pixel in the first box re-sampling area BA1 may display 37.5% of the maximum luminance, and the red sub-pixel in the second box re-sampling area BA2 may display 25% of the maximum luminance.

In the case where data corresponding to the third pixel PXL3 among the RGBW data RGBW has a red color with the maximum grayscale, when the box filter is applied, the red sub-pixel in the second box re-sampling area BA2 may display 62.5% of the maximum luminance.

In the case where data corresponding to the fourth pixel PXL4 among the RGBW data RGBW has a red color with the maximum grayscale, when the box filter is applied, the red sub-pixel in the second box re-sampling area BA2 may display 12.5% of the maximum luminance, and the red sub-pixel in the third box re-sampling area BA3 may display 50% of the maximum luminance.

In the case where data corresponding to the fifth pixel PXL5 among the RGBW data RGBW has a red color with the maximum grayscale, when the box filter is applied, the red sub-pixel in the third box re-sampling area BA3 may display 50% of the maximum luminance, and the red sub-pixel in the fourth box re-sampling area BA4 may display 12.5% of the maximum luminance.

In the case where data corresponding to the sixth pixel PXL6 among the RGBW data RGBW has a red color with the maximum grayscale, when the box filter is applied, the red sub-pixel in the fourth box re-sampling area BA4 may display 62.5% of the maximum luminance.

In the case where data corresponding to the seventh pixel PXL7 among the RGBW data RGBW has a red color with the maximum grayscale, when the box filter is applied, the red sub-pixel in the fourth box re-sampling area BA4 may display 25% of the maximum luminance, and the red sub-pixel in the fifth box re-sampling area BA5 may display 37.5% of the maximum luminance.

In the case where data corresponding to the eighth pixel PXL8 among the RGBW data RGBW has a red color with the maximum grayscale, when the box filter is applied, the red sub-pixel in the fifth box re-sampling area BA5 may display 62.5% of the maximum luminance.

Figure 13A:
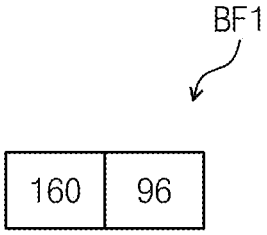
FIGS. 13A, 13B, 13C, 13D, and 13E are views illustrating first to fifth box filters.
Figure 13B:
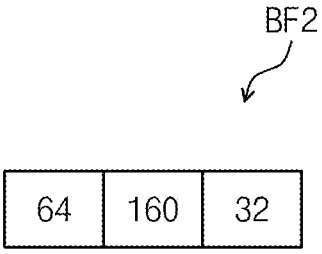
Figure 13C:
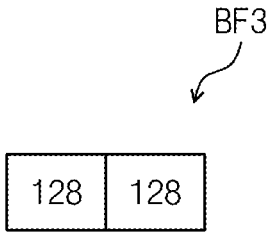
Figure 13D:
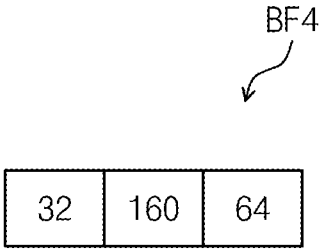
Figure 13E:
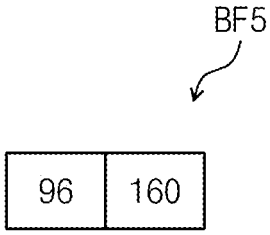

FIG. 13A is a view illustrating a first box filter BF1 having filter coefficients that are determined according to proportions of the first box re-sampling area BA1 that pixels occupy. FIGS. 13B to 13E are views illustrating second to fifth box filters BF2 to BF5 having filter coefficients that are determined according to proportions of the second to fifth block re-sampling areas BA2 to BA5 that pixels occupy, as similar to the first box filter BF1.

FIGS. 13A to 13E show the first to fifth re-sampling filters each have filter coefficients, a total sum of which is equal to 256. However, the inventive concept is not limited thereto, and the total sum may vary because the filter coefficients of each of the first to fifth box re-sampling filters BF1 to BF5 are expressed as proportions of one another. For example, the total sum of the filter coefficients of each of the first to fifth box filters BF1 to BF5 may be equal to 1 or may be greater than 256.

The first box filter BF1 may have filter coefficients arranged in the form of a 1×2 matrix. In the first box filter BF1, a filter coefficient in first row and first column may be 160, and a filter coefficient in first row and second column may be 96.

The second box filter BF2 may have filter coefficients arranged in the form of a 1×3 matrix. In the second box filter BF2, a filter coefficient in first row and first column may be 64, a filter coefficient in first row and second column may be 160, and a filter coefficient in first row and third column may be 32.

The third box filter BF3 may have filter coefficients arranged in the form of a 1×2 matrix. In the third box filter BF3, a filter coefficient in first row and first column may be 128, and a filter coefficient in first row and second column may be 128.

The fourth box filter BF4 may have filter coefficients arranged in the form of a 1×3 matrix. In the fourth box filter BF4, a filter coefficient in first row and first column may be 32, a filter coefficient in first row and second column may be 160, and a filter coefficient in first row and third column may be 64.

The fifth box filter BF5 may have filter coefficients arranged in the form of a 1×2 matrix. In the fifth box filter BF5, a filter coefficient in first row and first column may be 96, and a filter coefficient in first row and second column may be 160.

Figure 14:
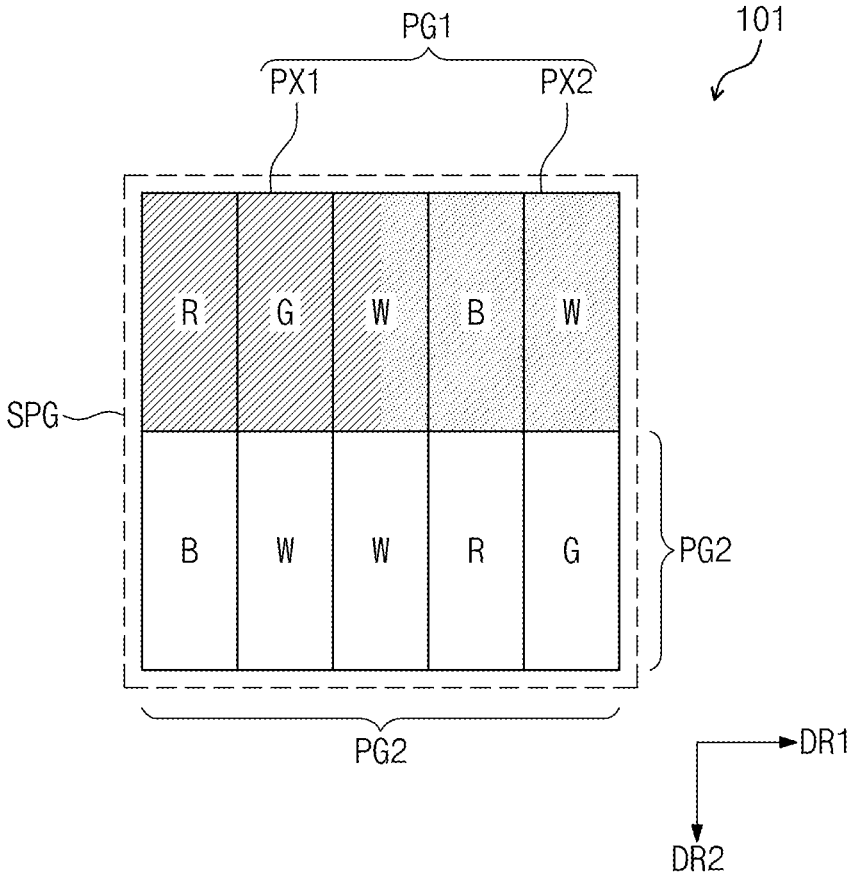
FIG. 14 is a view illustrating a portion of a display panel of FIG. 1 according to another embodiment of the inventive concept.

FIG. 14 is a view illustrating a portion of a display panel of FIG. 1 according to another embodiment of the inventive concept.

A display panel 101 shown in FIG. 14 is substantially similar to the display panel 100 shown in FIG. 2, except for color arrangement of sub-pixels. The display panel 101 shown in FIG. 14 will be described below, focusing on a difference with the display panel 100 shown in FIG. 2.

In FIG. 14, the sub-pixels R, G, B, and W may be repeatedly arranged in units of a sub-pixel group SPG including 10 sub-pixels that are arranged in a 2×5 matrix. The sub-pixel group SPG may include two red sub-pixels, two green sub-pixels, two blue sub-pixels, and four white sub-pixels.

Sub-pixels in first row of the sub-pixel group SPG may be arranged in a first direction DR1 in the order of a red sub-pixel R, a green sub-pixel G, a white sub-pixel W, and a blue sub-pixel B. In addition, sub-pixels in second row of the sub-pixel group SPG may be arranged in a first direction DR1 in the order of a blue sub-pixel B, at least one white sub-pixel W, a red sub-pixel R, and a green sub-pixel G. However, the inventive concept is not limited thereto, and the color arrangement of the sub-pixels may be variously changed.

A sub-pixel shared in a first pixel group PG1 may display a white color. In addition, a sub-pixel shared in a second pixel group PG2 may display a white color. That is, a shared sub-pixel in the display panel 101 of FIG. 14 may be a white sub-pixel that displays the white color.

With the display panel 101 shown in FIG. 14, it is possible to enhance the luminance level by increasing the number of white sub-pixels, compared to the display panel 100 shown in FIG. 2. With the display panel 101 shown in FIG. 14, it is also possible to reduce the area that is occupied by a white sub-pixel in each pixel, by sharing the white sub-pixel between two pixels of each pixel group, compared to a structure including two sub-pixels among RGBW sub-pixels of one pixel. Accordingly, this results in reduction of yellow to white ratio (Y/W ratio) due to addition of the white sub-pixel. "Y/W ratio" is a property for describing display quality, wherein "yellow" is a color having worst brightness with white background.

Figure 15:
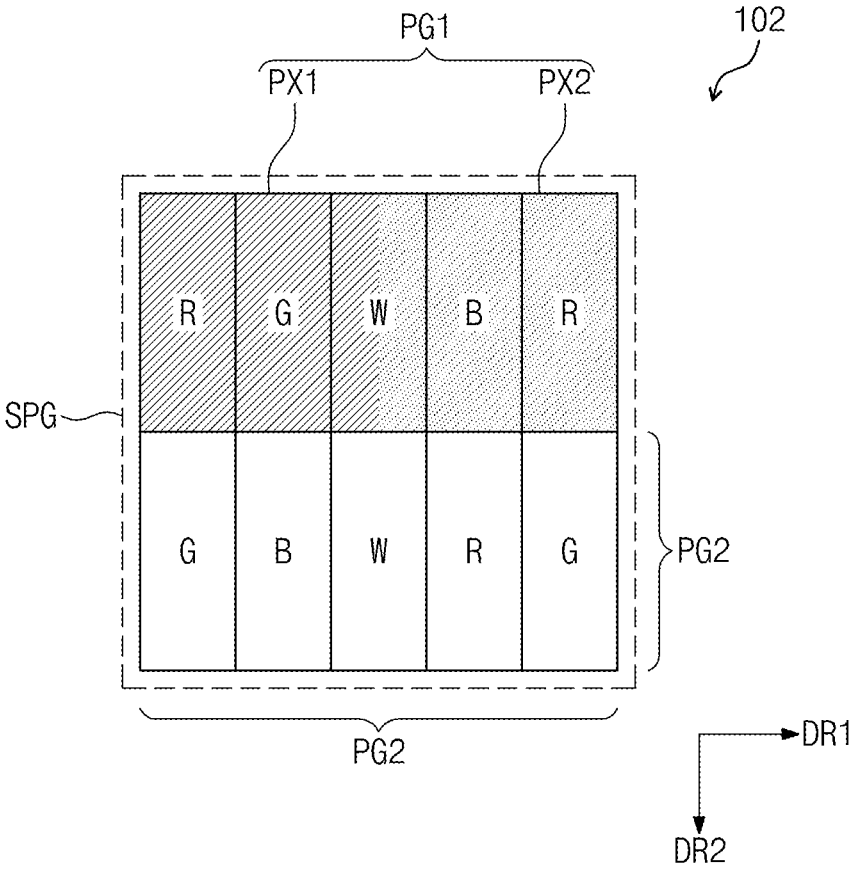
FIG. 15 is a view illustrating a portion of a display panel of FIG. 1 according to still another embodiment of the inventive concept.

FIG. 15 is a view illustrating a portion of a display panel of FIG. 1 according to still another embodiment of the inventive concept.

A display panel 102 shown in FIG. 15 is substantially similar to the display panel 100 shown in FIG. 2, except for color arrangement of sub-pixels. The display panel 102 shown in FIG. 15 will be described below, focusing on a difference with the display panel 100 shown in FIG. 2.

In FIG. 15, the sub-pixels R, G, B, and W may be repeatedly arranged in units of a sub-pixel group SPG including 10 sub-pixels that are arranged in a 2×5 matrix. The sub-pixel group SPG may include three red sub-pixels, three green sub-pixels, two blue sub-pixels, and two white sub-pixels.

Sub-pixels in first row of the sub-pixel group SPG may be arranged in a first direction DR1 in the order of a red sub-pixel R, a green sub-pixel G, a white sub-pixel W, a blue sub-pixel B, and the red sub-pixel R. In addition, sub-pixels in second row of the sub-pixel group SPG may be arranged in a first direction DR1 in the order of a green sub-pixel G, a blue sub-pixel B, a white sub-pixel W, a red sub-pixel R, and a green sub-pixel G. However, the inventive concept is not limited thereto, and the color arrangement of the sub-pixels may be variously changed.

A sub-pixel shared in a first pixel group PG1 may display a white color. In addition, a sub-pixel shared in a second pixel group PG2 may display a white color. That is, a shared sub-pixel in the display panel 102 of FIG. 15 may be a white sub-pixel that displays the white color.

With the display panel 102 shown in FIG. 15, it is possible to reduce an area of each pixel that a white sub-pixel occupies by sharing the white sub-pixel by two pixels of each pixel group (thereby putting 2.5 sub-pixels in a pixel area), compared to a structure including two sub-pixels among RGBW sub-pixels of one pixel. Accordingly, this results in reduction of a ratio of yellow to white (Y/W ratio) due to addition of the white sub-pixel.

Color recognition resolution of a human eye is green>red>blue>white. With the display panel 102 of FIG. 15, it is possible to enhance color recognition resolution of the display apparatus by disposing the red sub-pixels and green sub-pixels more than the blue sub-pixels and white sub-pixels.

The display apparatus according to an embodiment of the inventive concept can enhance a transmittance factor and an aperture ratio. The display apparatus may also enhance color reproduction of the display apparatus.

Although the embodiments of the inventive concept have been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the inventive concept.

What is claimed is:

1. A display apparatus, comprising:

a display panel including a plurality of pixels, each of the pixels including a plurality of sub-pixels, wherein two of the pixels collectively include five of the sub-pixels and the two pixels temporally share, with each other, one of the five sub-pixels, each of the two pixels temporally sharing at most one sub-pixel with any pixel other than itself;

a timing controller including a filter set based on an area having the same area as four of the sub-pixels, and configured to generate RGBW data having red, green, blue, and white data based on input data and apply the filter set to the RGBW data to generate output data corresponding to each of the sub-pixels and a sub-pixel rendering unit configured to perform a rendering operation on the RGBW data to generate rendering data corresponding to each of the sub-pixels;

a gate driver configured to provide gate signals to the sub-pixels; and a data driver configured to provide data voltages corresponding to the output data to the sub-pixels, wherein the sub-pixel rendering unit comprises:

a meta-sharp filter configured to compensate for distortion by applying the re-sampling filter to the RGBW data;

a self-sharpening filter configured to compensate for distortion by applying the re-sampling filter to a horizontal line pattern or vertical line pattern including a red, green, or blue color of the RGBW data;

a pattern detection filter including a first input terminal and a second input terminal, and configured to analyze the RGBW data and selectively output any one of data received through the first input terminal and data received through the second input terminal according to whether a dot pattern or diagonal pattern is detected; and a saturated color detection filter including a third input terminal and a fourth input terminal, and configured to analyze the saturation signal and selectively output any one of data received through the third input terminal and data received through the fourth input terminal according to whether a saturated color is detected, and wherein the two of the pixels collectively include no more than one pair of sub-pixels having a same color as each other.

2. The display apparatus of claim 1, wherein the sub-pixels are repeatedly arranged in units of a sub-pixel group including 8 sub-pixels arranged in a 2×4 or 4×2 matrix, and the sub-pixel group includes two red sub-pixels, two green sub-pixels, two blue sub-pixels, and two white sub-pixels.

3. The display apparatus of claim 1, wherein an aspect ratio of each of the pixels is substantially 1:1.

4. The display apparatus of claim 1, wherein an aspect ratio of each of the sub-pixels is substantially 1:2.5.

5. The display apparatus of claim 1, wherein sub-pixels arranged in a 2×5 matrix form a square-like shape.

6. The display apparatus of claim 1, wherein the timing controller comprises:

a gamma correction unit configured to linearize the input data;

a gamut mapping unit configured to map the linearized input data to a red color gamut, a green color gamut, a blue color gamut, and a white color gamut to generate the RGBW data;

a saturation data determination unit configured to analyze the RGBW data for each unit pixel data corresponding to each of the pixels to generate a saturation signal having information regarding whether to have saturated color data; and a reverse gamma correction unit configured to non-linearize the rendering data.

7. The display apparatus of claim 6, wherein first data, which is obtained by adding data obtained by applying the re-sampling filter to the RGBW data and data obtained by applying the self-sharpening filter to the RGBW data, is input to the first input terminal of the pattern detection filter, and second data, which is obtained by applying the box filter to the RGBW data, is input to the second input terminal of the pattern detection filter.

8. The display apparatus of claim 6, wherein third data, which is obtained by adding data obtained by applying the re-sampling filter to the RGBW data and data obtained by applying the meta-sharp filter to the RGBW data, is input to the third input terminal of the saturated color detection filter, and fourth data, which is output from the pattern detection filter, is input to the fourth input terminal of the saturated color detection filter.

9. The display apparatus of claim 6, wherein the re-sampling filter includes first to fifth re-sampling filters, the meta-sharp filter includes first to fifth meta-sharp filters calculated corresponding to the first to fifth re-sampling filters, respectively, the self-sharp filter includes first to fifth self-sharp filters calculated corresponding to the first to fifth re-sampling filters, respectively, and the box filter includes first to fifth box filters.

10. The display apparatus of claim 9, wherein the first re-sampling filter has filter coefficients arranged in the form of a 3×3 matrix, in which a filter coefficient in first row and first column is 0, a filter coefficient in first row and second column is 32, a filter coefficient in first row and third column is 0, a filter coefficient in second row and first column is 32, a filter coefficient in second row and second column is 152, a filter coefficient in second row and third column is 8, a filter coefficient in third row and first column is 0, a filter coefficient in third row and second column is 32, and a filter coefficient in third row and third column is 0, the second re-sampling filter has filter coefficients arranged in the form of a 3×2 matrix, in which a filter coefficient in first row and first column is 16, a filter coefficient in first row and second column is 16, a filter coefficient in second row and first column is 96, a filter coefficient in second row and second column is 96, a filter coefficient in third row and first column is 16, and a filter coefficient in third row and second column is 16, the third re-sampling filter has filter coefficients arranged in the form of a 3×3 matrix, in which a filter coefficient in first row and first column is 0, a filter coefficient in first row and second column is 32, a filter coefficient in first row and third column is 0, a filter coefficient in second row and first column is 8, a filter coefficient in second row and second column is 152, a filter coefficient in second row and third column is 32, a filter coefficient in third row and first column is 0, a filter coefficient in third row and second column is 32, and a filter coefficient in third row and third column is 0, the fourth re-sampling filter has filter coefficients arranged in the form of a 3×2 matrix, in which a filter coefficient in first row and first column is 4, a filter coefficient in first row and second column is 28, a filter coefficient in second row and first column is 64, a filter coefficient in second row and second column is 128, a filter coefficient in third row and first column is 4, and a filter coefficient in third row and second column is 28, and the fifth re-sampling filter has filter coefficients arranged in the form of a 3×2 matrix, in which a filter coefficient in first row and first column is 28, a filter coefficient in first row and second column is 4, a filter coefficient in second row and first column is 128, a filter coefficient in second row and second column is 64, a filter coefficient in third row and first column is 28, and a filter coefficient in third row and second column is 4.

11. The display apparatus of claim 9, wherein in the first meta-sharp filter, a filter coefficient in first row and first column is 0, a filter coefficient in first row and second column is −32, a filter coefficient in first row and third column is 0, a filter coefficient in second row and first column is −32, a filter coefficient in second row and second column is 104, a filter coefficient in second row and third column is −8, a filter coefficient in third row and first column is 0, a filter coefficient in third row and second column is −32, and a filter coefficient in third row and third column is 0, in the second meta-sharp filter, a filter coefficient in first row and first column is −16, a filter coefficient in first row and second column is −16, a filter coefficient in second row and first column is −32, a filter coefficient in second row and second column is 96, a filter coefficient in third row and first column is −16, and a filter coefficient in third row and second column is −16, in the third meta-sharp filter, a filter coefficient in first row and first column is 0, a filter coefficient in first row and second column is 32, a filter coefficient in first row and third column is 0, a filter coefficient in second row and first column is 8, a filter coefficient in second row and second column is 152, a filter coefficient in second row and third column is 32, a filter coefficient in third row and first column is 0, a filter coefficient in third row and second column is 32, and a filter coefficient in third row and third column is 0.

in the fourth meta-sharp filter, a filter coefficient in first row and first column is −4, a filter coefficient in first row and second column is −28, a filter coefficient in second row and first column is −64, a filter coefficient in second row and second column is 128, a filter coefficient in third row and first column is −4, and a filter coefficient in third row and second column is −28, and the fifth meta-sharp filter, a filter coefficient in first row and first column is −28, a filter coefficient in first row and second column is −4, a filter coefficient in second row and first column is 64, a filter coefficient in second row and second column is 0, a filter coefficient in third row and first column is −28, and a filter coefficient in third row and second column is −4.

12. The display apparatus of claim 9, wherein in the first self-sharp filter, a filter coefficient in first row and first column is −16, a filter coefficient in first row and second column is 0, a filter coefficient in first row and third column is −16, a filter coefficient in second row and first column is 0, a filter coefficient in second row and second column is 40, a filter coefficient in second row and third column is 24, a filter coefficient in third row and first column is −16, a filter coefficient in third row and second column is 0, and a filter coefficient in third row and third column is −16, in the second self-sharp filter, a filter coefficient in first row and first column is −16, a filter coefficient in first row and second column is −16, a filter coefficient in second row and first column is −32, a filter coefficient in second row and second column is 96, a filter coefficient in third row and first column is −16, and a filter coefficient in third row and second column is −16, in the third self-sharp filter, a filter coefficient in first row and first column is −20, a filter coefficient in first row and second column is −12, a filter coefficient in first row and third column is 0, a filter coefficient in second row and first column is 32, a filter coefficient in second row and second column is 0, a filter coefficient in second row and third column is 32, a filter coefficient in third row and first column is −20, a filter coefficient in third row and second column is −12, and a filter coefficient in third row and third column is 0, in the fourth self-sharp filter, a filter coefficient in first row and first column is −36, a filter coefficient in first row and second column is −4, a filter coefficient in second row and first column is 0, a filter coefficient in second row and second column is 128, a filter coefficient in third row and first column is −36, and a filter coefficient in third row and second column is −4, and in the fifth self-sharp filter SFS, a filter coefficient in first row and first column is −28, a filter coefficient in first row and second column is −4, a filter coefficient in second row and first column is 0, a filter coefficient in second row and second column is 64, a filter coefficient in third row and first column is −28, and a filter coefficient in third row and second column is −4.

13. The display apparatus of claim 9, wherein the first box filter has filter coefficients arranged in the form of a 1×2 matrix, in which a filter coefficient in first row and first column is 160, and a filter coefficient in first row and second column is 96, the second box filter has filter coefficients arranged in the form of a 1×3 matrix, in which a filter coefficient in first row and first column is 64, a filter coefficient in first row and second column is 160, and a filter coefficient in first row and third column is 32, the third box filter has filter coefficients arranged in the form of a 1×2 matrix, in which a filter coefficient in first row and first column is 128, and a filter coefficient in first row and second column is 128, the fourth box filter has filter coefficients arranged in the form of a 1×3 matrix, in which a filter coefficient in first row and first column is 32, a filter coefficient in first row and second column is 160, and a filter coefficient in first row and third column is 64, and the fifth box filter has filter coefficients arranged in the form of a 1×2 matrix, in which a filter coefficient in first row and first column is 96, and a filter coefficient in first row and second column is 160.

14. The display apparatus of claim 1, wherein the sub-pixels are repeatedly arranged in units of a sub-pixel group including 10 sub-pixels arranged in a 2×5 or 5×2 matrix, and the sub-pixel group includes two red sub-pixels, two green sub-pixels, two blue sub-pixels, and four white sub-pixels.

15. The display apparatus of claim 1, wherein the sub-pixels are repeatedly arranged in units of a sub-pixel group including 10 sub-pixels arranged in a 2×5 or 5×2 matrix, and the sub-pixel group includes three red sub-pixels, three green sub-pixels, two blue sub-pixels, and two white sub-pixels.

16. The display apparatus of claim 1, wherein each of the two pixels includes 2.5 sub-pixels, four sub-pixels of the five of the sub-pixels are different colored sub-pixels from each other, and the two pixels collectively consist of the five of the sub-pixels.

17. The display apparatus of claim 1, further comprising two other pixels of the plurality of pixels, the two other pixels horizontally or vertically adjacent to the two pixels, wherein one of either each of the two other pixels share a red, green or blue sub-pixel with each other or each of the two pixels temporally share a red, green or blue sub-pixel with each other.

18. The display apparatus of claim 6, wherein the filter set comprises:

a re-sampling filter configured to generate sub-pixel rendering data corresponding to a target pixel, based on data corresponding to the target pixel and data corresponding to pixels adjacent to the target pixel among the RGBW data; and a box filter configured to compensate for a dot pattern or diagonal pattern including a red, green, or blue color of the RGBW data.

* * * * *